US008541724B2

(12) United States Patent
Roemerman

(10) Patent No.: US 8,541,724 B2
(45) Date of Patent: Sep. 24, 2013

(54) SMALL SMART WEAPON AND WEAPON SYSTEM EMPLOYING THE SAME

(75) Inventor: Steven D. Roemerman, Highland Village, TX (US)

(73) Assignee: Lone Star IP Holdings, LP, Addison, TX (US)

( * ) Notice: Subject to any disclaimer, the term of this patent is extended or adjusted under 35 U.S.C. 154(b) by 0 days.

(21) Appl. No.: 12/850,421

(22) Filed: Aug. 4, 2010

(65) Prior Publication Data

US 2011/0017864 A1 Jan. 27, 2011

Related U.S. Application Data

(63) Continuation-in-part of application No. 11/706,489, filed on Feb. 15, 2007, which is a continuation-in-part of application No. 11/541,207, filed on Sep. 29, 2006, now Pat. No. 7,690,304.

(60) Provisional application No. 61/231,141, filed on Aug. 4, 2009.

(51) Int. Cl.

| | |
|---|---|
| ***F42B 15/01*** | (2006.01) |
| ***F41G 7/22*** | (2006.01) |
| ***G05D 1/12*** | (2006.01) |
| ***G02B 3/02*** | (2006.01) |
| ***G02B 3/08*** | (2006.01) |

(52) U.S. Cl.
USPC ..... 244/3.16; 359/709

(58) Field of Classification Search
USPC ..... 244/3.15, 3.16, 3.17; 359/709, 717, 359/720
See application file for complete search history.

(56) References Cited

U.S. PATENT DOCUMENTS

| | | | |
|---|---|---|---|
| 1,039,850 | A | 10/1912 | Völler |
| 1,077,989 | A | 11/1913 | Maxim |
| 1,240,217 | A | 9/1917 | Ingram |
| 1,312,764 | A | 8/1919 | Straub |
| 1,550,622 | A | 8/1925 | Lesh |
| 1,562,495 | A | 11/1925 | Dalton |
| 2,295,442 | A | 9/1942 | Wilhelm |
| 2,350,140 | A | 5/1944 | Wilton |
| 2,397,088 | A | 3/1946 | Clay |
| 2,445,311 | A | 7/1948 | Cooke et al. |
| 2,621,732 | A | 12/1952 | Ahlgren |
| 2,737,889 | A | 3/1956 | Barker |
| 2,767,656 | A | 10/1956 | Zeamer |

(Continued)

FOREIGN PATENT DOCUMENTS

EP 0 298 494 A2 1/1989

OTHER PUBLICATIONS

U.S. Appl. No. 10/841,192, filed May 7, 2004, Roemerman, et al.
U.S. Appl. No. 10/997,617, filed Nov. 24, 2004, Tepera, et al.

(Continued)

*Primary Examiner* — Bret Hayes
(74) *Attorney, Agent, or Firm* — Boisbrun Hofman, PLLC

(57) ABSTRACT

A weapon and weapon system, and methods of manufacturing and operating the same. In one embodiment, the weapon includes a warhead including destructive elements and a guidance section with a seeker configured to guide the weapon to a target. The seeker includes a detector configured to receive a distorted signal impinging on an objective lens from the target, memory configured to store target criteria and a correction map, and a processor configured to provide a correction signal based on the distorted signal, the target criteria and the correction map to guide the weapon to the target.

16 Claims, 17 Drawing Sheets

(56) References Cited

U.S. PATENT DOCUMENTS 2,809,583 A 10/1957 Ortynsky et al.
2,852,981 A 9/1958 Caya
2,911,914 A 11/1959 Wynn et al.
2,934,286 A 4/1960 Kiernan
2,958,260 A 11/1960 Anderson
3,211,057 A 10/1965 White, Jr. et al.
3,242,861 A 3/1966 Reed, Jr.
3,332,348 A 7/1967 Myers et al.
3,372,890 A * 3/1968 Bogard et al. ..... 244/3.17
3,377,952 A 4/1968 Crockett
3,379,131 A 4/1968 Webb
3,416,752 A * 12/1968 Hembree ..... 244/3.17
3,429,262 A 2/1969 Kincheloe et al.
3,545,383 A 12/1970 Lucy
3,555,826 A 1/1971 Bennett
3,625,106 A 12/1971 Russo et al.
3,625,152 A 12/1971 Schneider, Jr. et al.
3,667,342 A 6/1972 Warnock et al.
3,703,844 A 11/1972 Bleikamp, Jr.
3,728,935 A 4/1973 Magorian
3,759,466 A 9/1973 Evers-Euterneck
3,763,786 A 10/1973 MacDonald
3,771,455 A 11/1973 Haas
3,789,337 A 1/1974 Sheppard
3,820,106 A 6/1974 Yamashita et al.
3,872,770 A 3/1975 McGuire
3,887,991 A 6/1975 Panella
3,941,059 A 3/1976 Cobb
3,943,854 A 3/1976 Zwicker
3,954,060 A 5/1976 Haag et al.
3,956,990 A 5/1976 Rowe
3,995,792 A 12/1976 Otto et al.
3,998,124 A 12/1976 Milhous et al.
4,015,527 A 4/1977 Evans
4,036,140 A 7/1977 Korr et al.
4,091,734 A 5/1978 Redmond et al.
4,106,726 A * 8/1978 Emmons et al. ..... 244/3.17
4,172,407 A 10/1979 Wentink
4,211,169 A 7/1980 Brothers
4,291,848 A * 9/1981 Clark ..... 244/3.16
4,364,531 A 12/1982 Knoski
4,383,661 A 5/1983 Ottenheimer et al.
4,430,941 A 2/1984 Raech, Jr. et al.
4,478,127 A 10/1984 Hennings et al.
4,498,394 A 2/1985 Regebro
4,522,356 A 6/1985 Lair et al.
4,616,554 A 10/1986 Spink et al.
4,625,646 A 12/1986 Pinson
4,638,737 A 1/1987 McIngvale
4,648,324 A 3/1987 McDermott
4,709,877 A 12/1987 Goulding
4,714,020 A 12/1987 Hertsgaard et al.
4,744,301 A 5/1988 Cardoen
4,750,404 A 6/1988 Dale
4,750,423 A 6/1988 Nagabhushan
4,756,227 A 7/1988 Ash et al.
4,770,101 A 9/1988 Robertson et al.
4,775,432 A 10/1988 Kolonko et al.
4,777,882 A 10/1988 Dieval
4,803,928 A 2/1989 Kramer et al.
4,824,053 A 4/1989 Sarh
4,834,531 A * 5/1989 Ward ..... 356/5.08
4,842,218 A 6/1989 Groutage et al.
4,860,969 A 8/1989 Muller et al.
4,870,885 A 10/1989 Grosselin et al.
4,882,970 A 11/1989 Kovar
4,922,799 A 5/1990 Bartl et al.
4,922,826 A 5/1990 Busch et al.
4,932,326 A 6/1990 Ladriere
4,934,269 A 6/1990 Powell
4,936,187 A 6/1990 Teeter
4,957,046 A 9/1990 Puttock
4,996,923 A 3/1991 Theising
5,027,413 A * 6/1991 Barnard ..... 382/103
5,056,408 A 10/1991 Joner et al.
5,107,766 A 4/1992 Schliesske et al.
5,107,767 A 4/1992 Schneider et al.
5,127,605 A 7/1992 Atchison et al.
5,132,843 A 7/1992 Aoyama et al.
5,231,928 A 8/1993 Phillips et al.
5,311,820 A 5/1994 Ellingsen
5,322,998 A * 6/1994 Jackson ..... 250/216
5,325,786 A 7/1994 Petrovich
5,348,596 A 9/1994 Goleniewski et al.
5,413,048 A 5/1995 Werner et al.
5,438,366 A * 8/1995 Jackson et al. ..... 348/342
5,440,994 A 8/1995 Alexander
5,445,861 A * 8/1995 Newton et al. ..... 428/116
5,451,014 A 9/1995 Dare et al.
5,467,940 A 11/1995 Steuer
5,529,262 A 6/1996 Horwath
5,541,603 A 7/1996 Read et al.
5,546,358 A 8/1996 Thomson
5,561,261 A 10/1996 Lindstädt et al.
5,567,906 A 10/1996 Reese et al.
5,567,912 A 10/1996 Manning et al.
5,681,008 A 10/1997 Kinstler
5,682,266 A * 10/1997 Meyers ..... 359/571
5,691,502 A 11/1997 Craddock et al.
5,698,815 A 12/1997 Ragner
5,728,968 A 3/1998 Buzzett et al.
5,796,031 A 8/1998 Sigler
5,816,532 A 10/1998 Zasadny et al.
5,834,684 A 11/1998 Taylor
5,969,864 A 10/1999 Chen et al.
5,978,139 A 11/1999 Hatakoshi et al.
5,988,071 A 11/1999 Taylor
6,019,317 A 2/2000 Simmons et al.
6,021,716 A 2/2000 Taylor
6,105,505 A 8/2000 Jones
6,174,494 B1 1/2001 Lowden et al.
6,216,595 B1 4/2001 Lamorlette et al.
6,253,679 B1 7/2001 Woodall et al.
6,293,202 B1 9/2001 Woodall et al.
6,324,985 B1 12/2001 Petrusha
6,338,242 B1 1/2002 Kim et al.
6,374,744 B1 4/2002 Schmacker et al.
6,389,977 B1 5/2002 Schmacker et al.
6,523,477 B1 2/2003 Brooks et al.
6,523,478 B1 2/2003 Gonzalez et al.
6,540,175 B1 4/2003 Mayersak et al.
6,604,436 B1 * 8/2003 Lewandowski et al. ..... 73/865.6
6,615,116 B2 9/2003 Ebert et al.
6,666,123 B1 12/2003 Adams et al.
6,705,571 B2 3/2004 Shay et al.
6,779,754 B2 8/2004 Hellman
6,832,740 B1 12/2004 Ransom
6,834,835 B1 12/2004 Knowles et al.
6,869,044 B2 3/2005 Geswender et al.
6,871,817 B1 3/2005 Knapp
6,880,780 B1 4/2005 Perry et al.
6,910,661 B2 6/2005 Dockter et al.
6,933,877 B1 8/2005 Halladay et al.
7,019,650 B2 3/2006 Volpi et al.
7,051,974 B2 5/2006 Stuhr
7,083,140 B1 8/2006 Dooley
7,143,698 B2 12/2006 Lloyd
7,156,347 B2 1/2007 Lam et al.
7,221,847 B2 5/2007 Gardiner et al.
7,325,769 B1 2/2008 Harnisch et al.
7,340,986 B1 3/2008 Gaigler
7,474,476 B2 * 1/2009 Ueta et al. ..... 359/741
7,503,527 B1 3/2009 Fairchild
7,530,315 B2 5/2009 Tepera et al.
7,690,304 B2 4/2010 Roemerman et al.
7,789,343 B2 9/2010 Sarh et al.
7,958,810 B2 6/2011 Roemerman et al.
8,016,249 B2 9/2011 Sar et al.
8,127,683 B2 3/2012 Tepera et al.
2003/0051629 A1 3/2003 Zavitsanos et al.
2003/0123159 A1 7/2003 Morita et al.
2003/0192992 A1 10/2003 Olsen et al.
2004/0174261 A1 9/2004 Volpi et al.
2005/0127242 A1 6/2005 Rivers, Jr.

| | | | | |
|---|---|---|---|---|
| 2005/0180337 | A1 | 8/2005 | Roemerman et al. | |
| 2005/0201450 | A1 | 9/2005 | Volpi et al. | |
| 2006/0017545 | A1 | 1/2006 | Volpi et al. | |
| 2006/0077036 | A1 | 4/2006 | Roemerman et al. | |
| 2006/0198033 | A1 | 9/2006 | Soyama et al. | |
| 2007/0035383 | A1 | 2/2007 | Roemerman et al. | |
| 2007/0157843 | A1 | 7/2007 | Roemerman et al. | |
| 2009/0078146 | A1 | 3/2009 | Tepera et al. | |
| 2009/0228159 | A1 * | 9/2009 | Flowers et al. | 701/3 |
| 2010/0031841 | A1 | 2/2010 | Michel et al. | |
| 2010/0282893 | A1 | 11/2010 | Roemerman et al. | |
| 2010/0326264 | A1 | 12/2010 | Roemerman et al. | |
| 2012/0119013 | A1 | 5/2012 | Roemerman et al. | |
| 2012/0145822 | A1 | 6/2012 | Roemerman et al. | |
| 2012/0152091 | A1 | 6/2012 | Roemerman et al. | |

OTHER PUBLICATIONS

U.S. Appl. No. 11/501,348, filed Aug. 9, 2006, Roemerman, et al.
U.S. Appl. No. 11/541,207, filed Sep. 29, 2006, Roemerman, et al.
U.S. Appl. No. 11/706,489, filed Feb. 15, 2007, Roemerman, et al.
U.S. Appl. No. 60/706,822, filed Aug. 9, 2005, Roemerman, et al.
U.S. Appl. No. 60/722,475, filed Sep. 30, 2005, Roemerman, et al.
U.S. Appl. No. 60/773,746, filed Feb. 15, 2006, Roemerman, et al.
U.S. Appl. No. 60/855,084, filed Oct. 26, 2006, Roemerman, et al.

Andersson, O., et al., "High Velocity Jacketed Long Rod Projectiles Hitting Oblique Steel Plates," 19th International Symposium of Ballistics, May 7-11, 2001, pp. 1241-1247, Interlaken, Switzerland.
Davitt, R.P., "A Comparison of the Advantages and Disadvantages of Depleted Uranium and Tungsten Alloy as Penetrator Materials," Tank Ammo Section Report No. 107, Jun. 1980, 32 pages, U.S. Army Armament Research and Development Command, Dover, NJ.
"DOE Handbook: Primer on Spontaneous Heating and Pyrophoricity," Dec. 1994, 87 pages, DOE-HDBK-1081-94, FSC-6910, U.S. Department of Energy, Washington, D.C.
Rabkin, N.J., et al., "Operation Desert Storm: Casualties Caused by Improper Handling of Unexploded U.S. Submunitions," GAO Report to Congressional Requestors, Aug. 1993, 24 pages, GAO/NSAID-93-212, United States General Accounting Office, Washington, D.C.
Smart, M.C., et al., "Performance Characteristics of Lithium Ion Cells at Low Temperatures," IEEE AESS Systems Magazine, Dec. 2002, pp. 16-20, IEEE, Los Alamitos, CA.
"UNICEF What's New?: Highlight: Unexploded Ordnance (UXO)," http://www.unicef.org.vn/uxo.htm, downloaded Mar. 8, 2005, 3 pages.

* cited by examiner

SMALL SMART WEAPON AND WEAPON SYSTEM EMPLOYING THE SAME

This application is a continuation-in-part of U.S. patent application Ser. No. 11/706,489 entitled "Small Smart Weapon and Weapon System Employing the Same," filed Feb. 15, 2007, which is a continuation-in-part of U.S. patent application Ser. No. 11/541,207 entitled "Small Smart Weapon and Weapon System Employing the Same," filed Sep. 29, 2006, now U.S. Pat. No. 7,690,304, and also claims the benefit of U.S. Provisional Application No. 61/231,141 entitled "Novel Body Fixed Seekers and Variable Output Explosive Devices," filed Aug. 4, 2009, which applications are incorporated herein by reference.

TECHNICAL FIELD

The present invention is directed, in general, to weapon systems and, more specifically, to a weapon and weapon system, and methods of manufacturing and operating the same.

BACKGROUND

Present rules of engagement demand that precision guided weapons and weapon systems are necessary. According to well-documented reports, precision guided weapons have made up about 53 percent of all strike weapons employed by the United States from 1995 to 2003. The trend toward the use of precision weapons will continue. Additionally, strike weapons are used throughout a campaign, and in larger numbers than any other class of weapons. This trend will be even more pronounced as unmanned airborne vehicles ("UAVs") take on attack roles.

Each weapon carried on a launch platform (e.g., aircraft, ship, artillery) must be tested for safety, compatibility, and effectiveness. In some cases, these qualification tests can cost more to perform than the costs of the development of the weapon system. As a result, designers often choose to be constrained by earlier qualifications. In the case of smart weapons, this qualification includes data compatibility efforts. Examples of this philosophy can be found in the air to ground munitions ("AGM")-154 joint standoff weapon ("JSOW"), which was integrated with a number of launch platforms. In the process, a set of interfaces were developed, and a number of other systems have since been integrated which used the data sets and precedents developed by the AGM-154. Such qualifications can be very complex.

An additional example is the bomb live unit ("BLU")-116, which is essentially identical to the BLU-109 warhead in terms of weight, center of gravity and external dimensions. However, the BLU-116 has an external "shroud" of light metal (presumably aluminum alloy or something similar) and a core of hard, heavy metal. Thus, the BLU-109 was employed to reduce qualification costs of the BLU-116.

Another means used to minimize the time and expense of weapons integration is to minimize the changes to launch platform software. As weapons have become more complex, this has proven to be difficult. As a result, the delay in operational deployment of new weapons has been measured in years, often due solely to the problem of aircraft software integration.

Some weapons such as the Paveway II laser guided bomb [also known as the guided bomb unit ("GBU")-12] have no data or power interface to the launch platform. Clearly, it is highly desirable to minimize this form of interface and to, therefore, minimize the cost and time needed to achieve military utility.

Another general issue to consider is that low cost weapons are best designed with modularity in mind. This generally means that changes can be made to an element of the total weapon system, while retaining many existing features, again with cost and time in mind.

Another consideration is the matter of avoiding unintended damage, such as damage to non-combatants. Such damage can take many forms, including direct damage from an exploding weapon, or indirect damage. Indirect damage can be caused by a "dud" weapon going off hours or weeks after an attack, or if an enemy uses the weapon as an improvised explosive device. The damage may be inflicted on civilians or on friendly forces.

One term of reference is "danger close," which is the term included in the method of engagement segment of a call for fire that indicates that friendly forces or non-combatants are within close proximity of the target. The close proximity distance is determined by the weapon and munition fired. In recent United States engagements, insurgent forces fighting from urban positions have been difficult to attack due to such considerations.

To avoid such damage, a number of data elements may be provided to the weapon before launch, examples of such data include information about coding on a laser designator, so the weapon will home in on the right signal. Another example is global positioning system ("GPS") information about where the weapon should go, or areas that must be avoided. Other examples could be cited, and are familiar to those skilled in the art.

Therefore, what is needed is a small smart weapon that can be accurately guided to an intended target with the effect of destroying that target with little or no collateral damage of other nearby locations. Also, what is needed is such a weapon having many of the characteristics of prior weapons already qualified in order to substantially reduce the cost and time for effective deployment.

SUMMARY OF THE INVENTION

These and other problems are generally solved or circumvented, and technical advantages are generally achieved, by advantageous embodiments of the present invention, which includes a weapon and weapon system, and methods of manufacturing and operating the same. In one embodiment, the weapon includes a warhead including destructive elements and a guidance section with a seeker configured to guide the weapon to a target. The seeker includes a detector configured to receive a distorted signal impinging on an objective lens from the target, memory configured to store target criteria and a correction map, and a processor configured to provide a correction signal based on the distorted signal, the target criteria and the correction map to guide the weapon to the target.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

Figure 1:
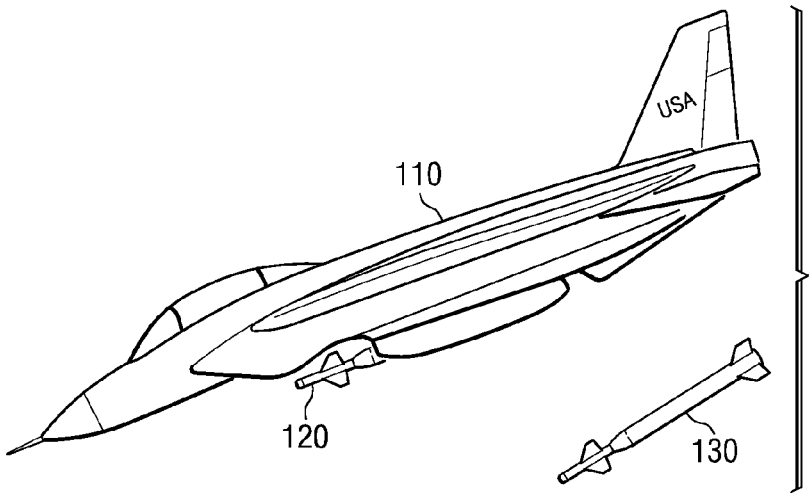
FIG. 1 illustrates a view of an embodiment of a weapon system in accordance with the principles of the present invention.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

It should be understood that the military utility of the weapon can only be fully estimated in the context of a so-called system of systems, which includes a guidance section or system, the delivery vehicle or launch platform, and other things, in addition to the weapon per se. In this sense, a weapon system is disclosed herein, even when we are describing a weapon per se. One example is seen in the discussion of the GBU-12, wherein design choices within the weapon were reflected in the design and operation of many aircraft that followed the introduction of the GBU-12. Another example is the use of a laser designator for laser guided weapons. Design choices in the weapon can enhance or limit the utility of the designator. Other examples can be cited. Those skilled in the art will understand that the discussion of the weapon per se inherently involves a discussion of the larger weapon system of systems. Therefore, improvements within the weapon often result in corresponding changes or improvements outside the weapon, and new teachings about weapons teach about weapon platforms, and other system of systems elements.

In accordance therewith, a class of warhead assemblies, constituting systems, methods, and devices, with many features, including multiple, modular guidance subsystems, avoidance of collateral damage, unexploded ordinance, and undesirable munitions sensitivity is described herein. In an exemplary embodiment, the warheads are Mark derived (e.g., MK-76) or bomb dummy unit ("BDU") derived (e.g., BDU-33) warheads. The MK-76 is about four inches in diameter, 24.5 inches in length, 95-100 cubic inches ("cu") in internal volume, 25 pounds ("lbs") and accommodates a 0.85 inch diameter practice bomb cartridge. This class of assemblies is also compatible with existing weapon envelopes of size, shape, weight, center of gravity, moment of inertia, and structural strength to avoid lengthy and expensive qualification for use with manned and unmanned platforms such as ships, helicopters, self-propelled artillery and fixed wing aircraft, thus constituting systems and methods for introducing new weapon system capabilities more quickly and at less expense. In addition, the weapon system greatly increases the number of targets that can be attacked by a single platform, whether manned or unmanned.

In an exemplary embodiment, the general system envisioned is based on existing shapes, such as the MK-76, BDU-33, or laser guided training round ("LGTR"). The resulting system can be modified by the addition or removal of various features, such as global positioning system ("GPS") guidance, and warhead features. In addition, non-explosive warheads, such as those described in U.S. patent application Ser. No. 10/841,192 entitled "Weapon and Weapon System Employing The Same," to Roemerman, et al., filed May 7, 2004, U.S. patent application Ser. No. 10/997,617 entitled "Weapon and Weapon System Employing the Same," to Tepera, et al., filed Nov. 24, 2004, now U.S. Pat. No. 7,530,315, and U.S. patent application Ser. No. 11/925,471 entitled "Weapon Interface System and Delivery Platform Employing the Same," to Roemerman, et al., filed Oct. 26, 2006, which are incorporated herein by reference, may also be employed with the weapon according to the principles of the present invention.

Another feature of the system is the use of system elements for multiple purposes. For example, the central structural element of the MK-76 embodiment includes an optics design with a primary optical element, which is formed in the mechanical structure rather than as a separate component. Another example is the use of an antenna for both radio guidance purposes, such as GPS, and for handoff communication by means such as those typical of a radio frequency identification ("RFID") system. For examples of RFID related systems, see U.S. patent application Ser. No. 11/501,348, entitled "Radio Frequency Identification Interrogation Systems and Methods of Operating the Same," to Roemerman, et al., filed Aug. 9, 2006, now U.S. Patent Application Publication No. 2007/0035383, U.S. Pat. No. 7,019,650 entitled "Interrogator and Interrogation System Employing the Same," to Volpi, et al., issued on Mar. 28, 2006, U.S. Patent Application Publication No. 2006/0077036, entitled "Interrogation System Employing Prior Knowledge About An Object To Discern An Identity Thereof," to Roemerman, et al., filed Sep. 29, 2005, U.S. Patent Application Publication No. 2006/0017545, entitled "Radio Frequency Identification Interrogation Systems and Methods of Operating the Same," to Volpi, et al., filed Mar. 25, 2005, U.S. Patent Application Publication No. 2005/0201450, entitled "Interrogator And Interrogation System Employing The Same," to Volpi, et al., filed Mar. 3, 2005, all of which are incorporated herein by reference.

Referring now to FIG. 1, illustrated is a view of an embodiment of a weapon system in accordance with the principles of the present invention. The weapon system includes a delivery vehicle (e.g., an airplane such as an F-14) 110 and at least one weapon. As demonstrated, a first weapon 120 is attached to the delivery vehicle (e.g., a wing station) and a second weapon 130 is deployed from the delivery vehicle 110 intended for a target. Of course, the first weapon 120 may be attached to a rack in the delivery vehicle or a bomb bay therein.

The weapon system is configured to provide energy as derived, without limitation, from a velocity and altitude of the delivery vehicle 110 in the form of kinetic energy ("KE") and potential energy to the first and second weapons 120, 130 and, ultimately, the warhead and destructive elements therein. The first and second weapons 120, 130 when released from the delivery vehicle 110 provide guided motion for the warhead to the target. The energy transferred from the delivery vehicle 110 as well as any additional energy acquired through the first and second weapons 120, 130 through propulsion, gravity or other parameters, provides the kinetic energy to the warhead to perform the intended mission. While the first and second weapons 120, 130 described with respect to FIG. 1 represent precision guided weapons, those skilled in the art understand that the principles of the present invention also apply to other types of weapons including weapons that are not guided by guidance technology or systems.

In general, it should be understood that other delivery vehicles including other aircraft may be employed such that the weapons contain significant energy represented as kinetic energy plus potential energy. As mentioned above, the kinetic energy is equal to "$\frac{1}{2}mv^2$," and the potential energy is equal to "mgh" where "m" is the mass of the weapon, "g" is gravitational acceleration equal to 9.8 $M/sec^2$, and "h" is the height of the weapon at its highest point with respect to the height of the target. Thus, at the time of impact, the energy of the weapon is kinetic energy, which is directed into and towards the destruction of the target with little to no collateral damage of surroundings. Additionally, the collateral damage may be further reduced if the warhead is void of an explosive charge.

Figure 2:
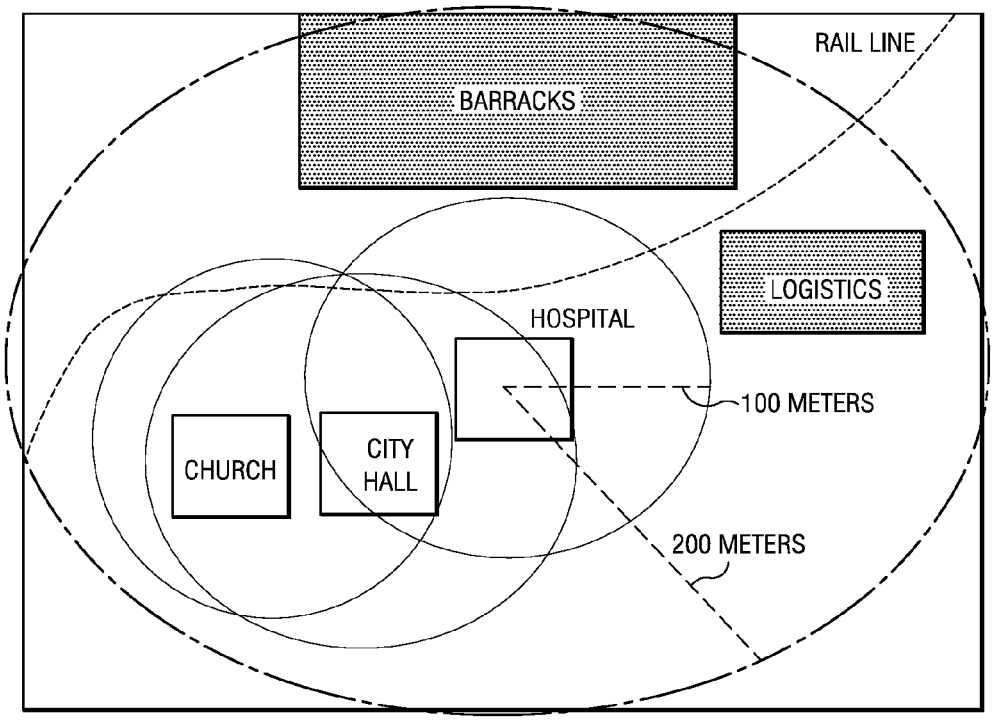
FIG. 2 illustrates a diagram demonstrating a region including a target zone for a weapon system in accordance with the principles of the present invention.

Turning now to FIG. 2, illustrated is a diagram demonstrating a region including a target zone for a weapon system in accordance with the principles of the present invention. The entire region is about 200 meters (e.g., about 2.5 city blocks) and the structures that are not targets take up a significant portion of the region. For instance, the weapon system would not want to target the hospital and a radius including about a 100 meters thereabout. In other words, the structures that are not targets are danger close to the targets. A barracks and logistics structure with the rail line form the targets in the illustrated embodiment.

Figure 3:
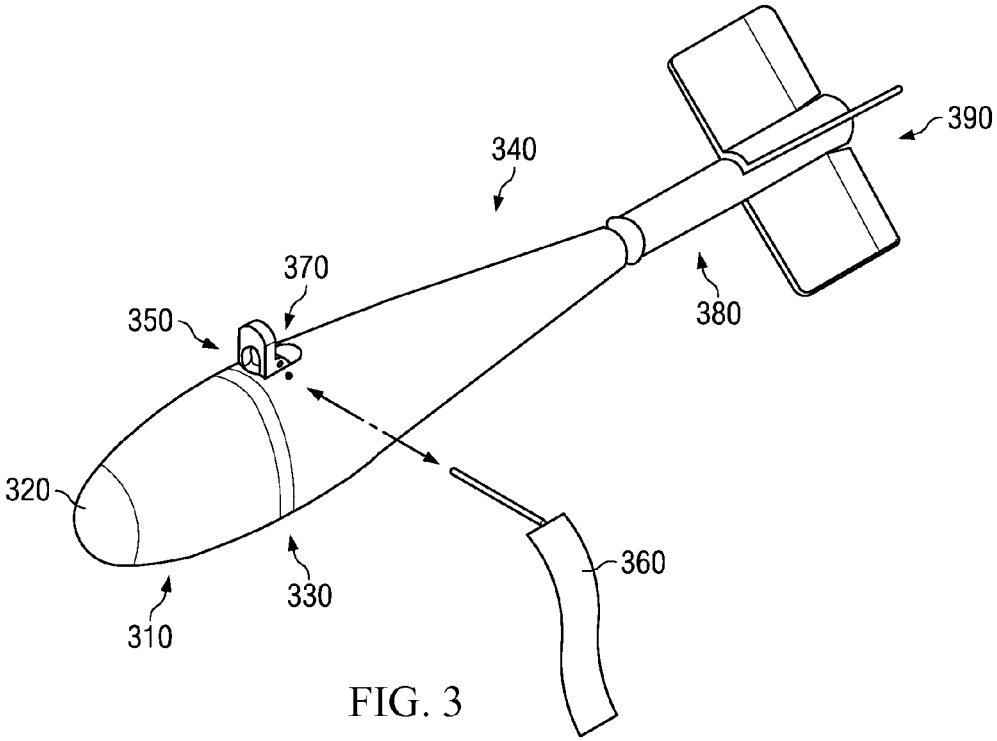
FIG. 3 illustrates a perspective view of an embodiment of a weapon constructed according to the principles of the present invention.

Turning now to FIG. 3, illustrated is a perspective view of an embodiment of a weapon constructed according to the principles of the present invention. The weapon includes a guidance section 310 including a target sensor (e.g., a laser seeker) 320, and guidance and control electronics and logic to guide the weapon to a target. The target sensor 320 may include components and subsystems such as a crush switch, a semi-active laser based terminal seeker ("SAL") quad detector, a net cast corrector and lenses for an optical system. In accordance with SAL systems, net cast optics are suitable, since the spot for the terminal seeker is normally defocused.

The guidance section 310 may include components and subsystems such as a GPS, an antenna such as a ring antenna 330 (e.g., dual use handoff and data and mission insertion similar to radio frequency identification and potentially also including responses from the weapon via similar means), a multiple axis microelectromechanical gyroscope, safety and arming devices, fuzing components, a quad detector, a communication interface [e.g., digital subscriber line ("DSL")], and provide features such as low power warming for fast acquisition and inductive handoff with a personal information manager. In the illustrated embodiment, the antenna 330 is about a surface of the weapon. Thus, the antenna is configured to receive mission data such as location, laser codes, GPS ephemerides and the like before launching from a delivery vehicle to guide the weapon to a target. The antenna is also configured to receive instructions after launching from the delivery vehicle to guide the weapon to the target. The weapon system, therefore, includes a communication system, typically within the delivery vehicle, to communicate with the weapon, and to achieve other goals and ends in the context of weapon system operation. It should be understood that the guidance section 310 contemplates, without limitation, laser guided, GPS guided, and dual mode laser and GPS guided systems. It should be understood that this antenna may be configured to receive various kinds of electromagnetic energy, just as there are many types of RFID tags that are configured to receive various kinds of electromagnetic energy.

The weapon also includes a warhead 340 (e.g., a unitary configuration) having destructive elements (formed from explosive or non-explosive materials), mechanisms and elements to articulate aerodynamic surfaces. A folding lug switch assembly 350, safety pin 360 and cavity 370 are also coupled to the guidance section 310 and the warhead 340. The guidance section 310 is in front of the warhead 340. The folding lug switch assembly 350 projects from a surface of the weapon. The weapon still further includes an aft section 380 behind the warhead 340 including system power elements, a ballast, actuators, flight control elements, and tail fins 390.

For instances when the target sensor is a laser seeker, the laser seeker detects the reflected energy from a selected target which is being illuminated by a laser. The laser seeker provides signals so as to drive the control surfaces in a manner such that the weapon is directed to the target. The tail fins 390 provide both stability and lift to the weapon. Modern precision guided weapons can be precisely guided to a specific target so that considerable explosive energy is often not needed to destroy an intended target. In many instances, kinetic energy discussed herein may be sufficient to destroy a target, especially when the weapon can be directed with sufficient accuracy to strike a specific designated target.

The destructive elements of the warhead 340 may be constructed of non-explosive materials and selected to achieve penetration, fragmentation, or incendiary effects. The destructive elements (e.g., shot) may include an incendiary material such as a pyrophoric material (e.g., zirconium) therein. The term "shot" generally refers a solid or hollow spherical, cubic, or other suitably shaped element constructed of explosive or non-explosive materials, without the aerodynamic characteristics generally associated with, for instance, a "dart." The shot may include an incendiary material such as a pyrophoric material (e.g., zirconium) therein. Inasmuch as the destructive elements of the warhead are a significant part of the weapon, the placement of these destructive elements, in order to achieve the overall weight and center of gravity desired, is an important element in the design of the weapon.

The non-explosive materials applied herein are substantially inert in environments that are normal and under benign conditions. Nominally stressing environments such as experienced in normal handling are generally insufficient to cause the selected materials (e.g., tungsten, hardened steel, zirconium, copper, depleted uranium and other like materials) to become destructive in an explosive or incendiary manner. The latent lethal explosive factor is minimal or non-existent. Reactive conditions are predicated on the application of high kinetic energy transfer, a predominantly physical reaction, and not on explosive effects, a predominantly chemical reaction.

The folding lug switch assembly 350 is typically spring-loaded to fold down upon release from, without limitation, a rack on an aircraft. The folding lug switch assembly 350 permits initialization after launch (no need to fire thermal batteries or use other power until the bomb is away) and provides a positive signal for a fuze. The folding lug switch assembly 350 is consistent with the laser guided bomb ("LGB") strategy using lanyards, but without the logistics issues of lanyards. The folding lug switch assembly 350 also makes an aircraft data and power interface optional and supports a visible "remove before flight" pin. The folding lug switch assembly 350 provides a mechanism to attach the weapon to a delivery vehicle and is configured to close after launching from the delivery vehicle thereby satisfying a criterion to arm the warhead. It should be understood, however, that the folding lug switch assembly 350, which is highly desirable in some circumstances, can be replaced with other means of carriage and suspension, and is only one of many features of the present invention, which can be applied in different combinations to achieve the benefits of the weapon system.

Typically, the safety pin 360 is removed from the folding lug switch assembly 350 and the folding lug switch assembly 350 is attached to a rack of an aircraft to hold the folding lug switch assembly 350 in an open position prior to launch. Thus, the safety pin 360 provides a mechanism to arm the weapon. Once the weapon is launched from the aircraft, the folding lug switch assembly 350 folds down into the cavity 370 and provides another mechanism to arm the weapon. A delay circuit between the folding lug switch assembly 350 and the fuze may be yet another mechanism to arm or provide time to disable the weapon after launch. Therefore, there are often three mechanisms that are satisfied before the weapon is ultimately armed enroute to the target.

A number of circuits are now well understood that use power from radio frequency or inductive fields to power a receiving chip and store data. The antenna includes an interface to terminate with the aircraft interface at the rack for loading relevant mission data including target, location, laser codes, GPS ephemerides and the like before being launched. Programming may be accomplished by a hand-held device similar to a fuze setter or can be programmed by a lower power interface between a rack and the weapon. Other embodiments are clearly possible to those skilled in the art. The antenna serves a dual purpose for handoff and GPS. In other words, the antenna is configured to receive instructions after launching from the delivery vehicle to guide the weapon to the target. Typically, power to the weapon is not required prior to launch, therefore no umbilical cable is needed. Alternative embodiments for power to GPS prior to launch are also contemplated herein.

The modular design of the weapon allows the introduction of features such as GPS and other sensors as well. Also, the use of a modular warhead 340 with heavy metal ballast makes the low cost kinetic [no high explosives ("HE")] design option practical and affordable.

As illustrated in an exemplary embodiment of a weapon in the TABLE 1 below, the weapon may be designed to have a similar envelope, mass, and center of gravity already present in existing aircraft for a practice bomb version thereof. Alternatively, the weapon may be designed with other envelopes, masses, and centers of gravity, as may be available with other configurations, as also being included within the constructs of this invention.

TABLE 1

| FUNCTION | MATERIAL | DENSITY (LB/CU IN) | WEIGHT (LB) | VOLUME (CU IN) |
|---|---|---|---|---|
| Ballast/KE | Tungsten | 0.695 | 20.329 | 29.250 |
| Structure, Metal Augmented Charge ("MAC") Explosive | Aluminum | 0.090 | 0.270 | 3.000 |
| Dome | Pyrex | 0.074 | 0.167 | 2.250 |
| Structure | Steel | 0.260 | 1.430 | 5.500 |

TABLE 1-continued

| FUNCTION | MATERIAL | DENSITY (LB/CU IN) | WEIGHT (LB) | VOLUME (CU IN) |
|---|---|---|---|---|
| Guidance | Misc Electronics | 0.033 | 0.800 | 24.000 |
| Primary Explosive | Polymer Bonded Explosive ("PBX") | 0.057 | 2.040 | 36.000 |
| Total | SSW | 0.250 | 25.036 | 100.000 |
| MK-76 | | 0.250 | 25.000 | 100.000 |

In the above example, the weapon is MK-76 derived, but others such as BDU-33 are well within the broad scope of the present invention. The weapon provides for very low cost of aircraft integration. The warhead 340 is large enough for useful warheads and small enough for very high carriage density. The modular design of the weapon allows many variants and is compatible with existing handling and loading methods.

The following TABLEs 2 and 3 provide a comparison of several weapons to accentuate the advantages of small smart weapons such as the MK-76 and BDU-33.

TABLE 2

| CANDIDATE | AIRCRAFT ("A/C") CLEARED | WEIGHT (LB) | DIAMETER (IN - APPROX) | REMARKS |
|---|---|---|---|---|
| LGB/MK-81 | None | 250+ | 10 | Canceled variant |
| MK-76/BDU33 | All | 25 | 4 | Low drag practice bomb |
| BDU-48 | All | 10 | 3.9 | High drag practice bomb |
| MK-106 | All | 5 | 3.9 | High drag practice bomb |
| SDB | Most US | 285 | 7.5 | GBU-39 Small Dia. Bomb |

TABLE 3

| CANDIDATE | CLEARED ON MANY A/C? | LARGE ENOUGH FOR WARHEAD? | VIABLE FOR EXPORT? | HIGH DENSITY CARRIAGE? | COMPATIBLE WITH TUBE LAUNCH? |
|---|---|---|---|---|---|
| LGB/MK-81 | No | Yes | Yes | No | No |
| MK-76/BDU33 | All | Yes | Yes | Yes | Yes |
| BDU-48 | All | No | Yes | Yes | Yes |
| MK-106 | All | No | Yes | Yes | Yes |
| SDB | Most US | Yes | No | Yes | No |

The aforementioned tables provide a snapshot of the advantages associated with small smart weapons, such as, procurements are inevitable, and the current weapons have limited utility due to political, tactical, and legal considerations. Additionally, the technology is ready with much of it being commercial off-the-shelf technology and the trends reflect these changes. The smart weapons are now core doctrine and contractors can expect production in very large numbers. Compared to existing systems, small smart weapons exhibit smaller size, lower cost, equally high or better accuracy, short time to market, and ease of integration with an airframe, which are key elements directly addressed by the weapon disclosed herein. As an example, the small smart weapon could increase an unmanned combat air vehicle ("UCAV") weapon count by a factor of two or more over a small diameter bomb ("SDB") such as a GBU-39/B.

The small smart weapons also address concerns with submunitions, which are claimed by some nations to fall under the land mine treaty. The submunitions are a major source of unexploded ordnance, causing significant limitations to force maneuvers, and casualties to civilians and blue forces. Submunitions are currently the only practical way to attack area targets, such as staging areas, barracks complexes, freight yards, etc. Unexploded ordnance from larger warheads are a primary source of explosives for improvised explosive devices. While the broad scope of the present invention is not so limited, small smart weapons including small warheads, individually targeted, alleviate or greatly reduce these concerns.

Figure 4:
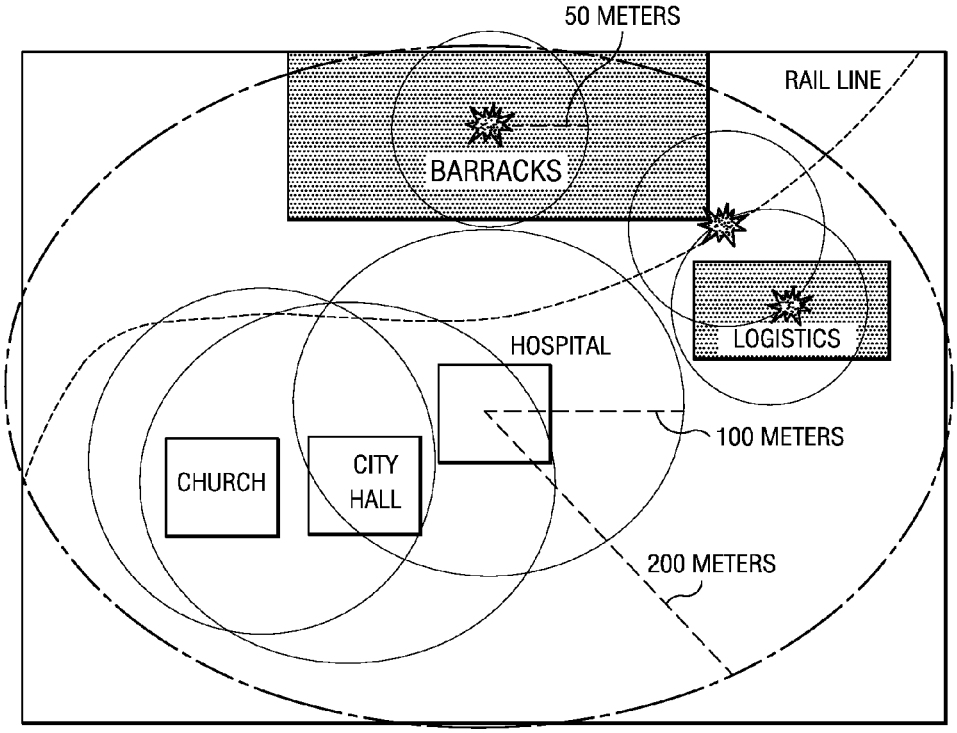
FIG. 4 illustrates a diagram demonstrating a region including a target zone for a weapon system in accordance with the principles of the present invention.

Turning now to FIG. 4, illustrated is a diagram demonstrating a region including a target zone for a weapon system in accordance with the principles of the present invention. Analogous to the regions illustrated with respect to FIG. 2, the entire region is about 200 meters (e.g., about 2.5 city blocks) and the structures that are not targets take up a significant portion of the region. In the illustrated embodiment, the lethal diameter for the weapon is about 10 meters and the danger close diameter is about 50 meters. Thus, when the weapon strikes the barracks, rail line or logistics structure as shown, the weapon according to the principles of the present invention provides little or no collateral damage to, for instance, the hospital. While only a few strikes of a weapon are illustrated herein, it may be preferable to cause many strikes at the intended targets, while at the same time being cognizant of the collateral damage.

In an exemplary embodiment, a sensor of the weapon detects a target in accordance with, for instance, pre-programmed knowledge-based data sets, target information, weapon information, warhead characteristics, safe and arm events, fuzing logic and environmental information. In the target region, sensors and devices detect the target and non-target locations and positions. Command signals including data, instructions, and information contained in the weapon (e.g., a control section) are passed to the warhead. The data, instructions, and information contain that knowledge which incorporates the functional mode of the warhead such as safe and arming conditions, fuzing logic, deployment mode and functioning requirements.

The set of information as described above is passed to, for instance, an event sequencer of the warhead. In accordance therewith, the warhead characteristics, safe and arm events, fuzing logic, and deployment modes are established and executed therewith. At an instant that all conditions are properly satisfied (e.g., a folding lug switch assembly is closed), the event sequencer passes the proper signals to initiate a fire signal to fuzes for the warhead. In accordance herewith, a functional mode for the warhead is provided including range characteristics and the like. Thereafter, the warhead is guided to the target employing the guidance section employing, without limitation, an antenna and global positioning system.

Thus, a class of warhead assemblies, constituting systems, methods, and devices, with many features, including multiple, modular guidance subsystems, avoidance of collateral damage, unexploded ordinance, and undesirable munitions sensitivity has been described herein. The weapon according to the principles of the present invention provides a class of warheads that are compatible with existing weapon envelopes of size, shape, weight, center of gravity, moment of inertia, and structural strength, to avoid lengthy and expensive qualification for use with manned and unmanned platforms such as ships, helicopters, self-propelled artillery and fixed wing aircraft, thus constituting systems and methods for introducing new weapon system capabilities more quickly and at less expense. In addition, the weapon system greatly increases the number of targets that can be attacked by a single platform, whether manned or unmanned.

Figure 5:
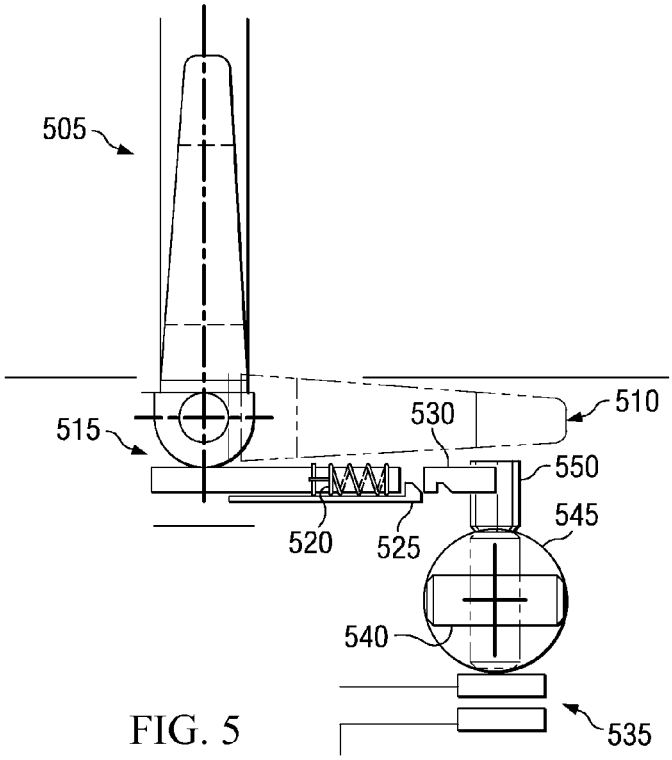
FIG. 5 illustrates a diagram of an embodiment of a folding lug switch assembly constructed in accordance with the principles of the present invention.

Turning now to FIG. 5, illustrated is a diagram of an embodiment of a folding lug switch assembly constructed in accordance with the principles of the present invention. More specifically, a folding lug of the folding lug switch assembly is shown in an upright position 505 and in a folded position 510. The folding lug switch assembly includes a rack and pinion 515, which in an alternative embodiment can also be a cam. The folding lug switch assembly also includes a return spring 520 that provides the energy to fold the folding lug down and retract a retracting cam 525, which interacts with a switch sear 530 to release an arming pin 535 and thus activate an arming rotor 540, an arming plunger 545, and finally a power switch 550. This invention comprehends a folding lug switch assembly that may have multiple functions beyond arming including weapon guidance. It may also have multiple poles and multiple throws that, as an example, may be used for purposes such as isolating arming circuits from other circuits.

Referring once more to the target sensor discussed above, a semi-active laser ("SAL") seeker is typically the most complex item in SAL guided systems, and SAL is the most commonly used means of guiding precision weapons. Therefore, a low cost and compact approach, consistent with a very confined space, is highly desirable.

Figure 6A:
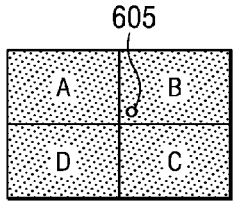
FIGS. 6A and 6B illustrate diagrams demonstrating a four quadrant semi active laser detector constructed in accordance with the principles of the present invention.
Figure 6B:
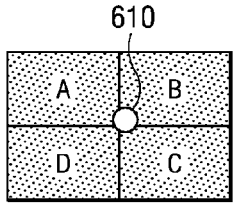

Turning now to FIGS. 6A and 6B, illustrated are diagrams demonstrating a four quadrant semi active laser detector constructed in accordance with the principles of the present invention. More specifically, FIG. 6A represents a typical four quadrant seeker having quadrants A, B, C, and D. This system is capable of providing both elevation information ("EL") and azimuth information ("AZ") according to the following equations:

$$EL=((A+B)-(C+D))/(A+B+C+D), \text{ and}$$

$$AZ=((A+D)-(B+C))/(A+B+C+D).$$

A reflected spot from a laser 605 is shown in quadrant B where the spot is focused on the plane of the active detecting area.

Turning now to FIG. 6B, illustrated is the same basic conditions of FIG. 6A, except that a spot 610 has been intentionally defocused so that, for a target near bore sight, a linear (i.e., proportional) output results. By these illustrations, it is therefore seen that focused systems are prone to indicate in which quadrant a signal may reside, while a defocused system will support proportional guidance as shown by illuminating more than one quadrant in the region of boresight where proportional guidance is most important.

Figure 7A:
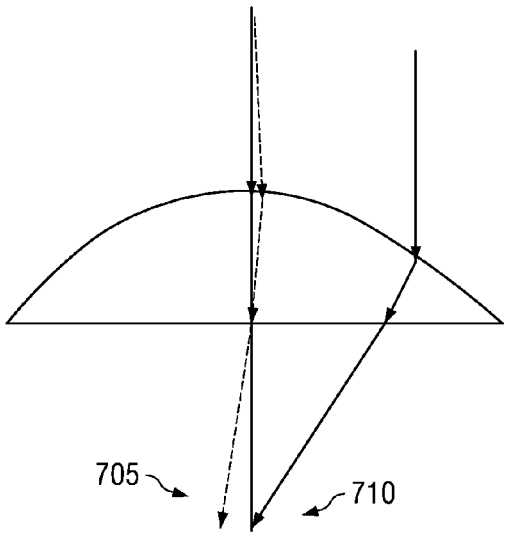
FIGS. 7A and 7B illustrate the properties of a conventional and fast fresnel lens ("FFL") constructed in accordance with the principles of the present invention.
Figure 7B:
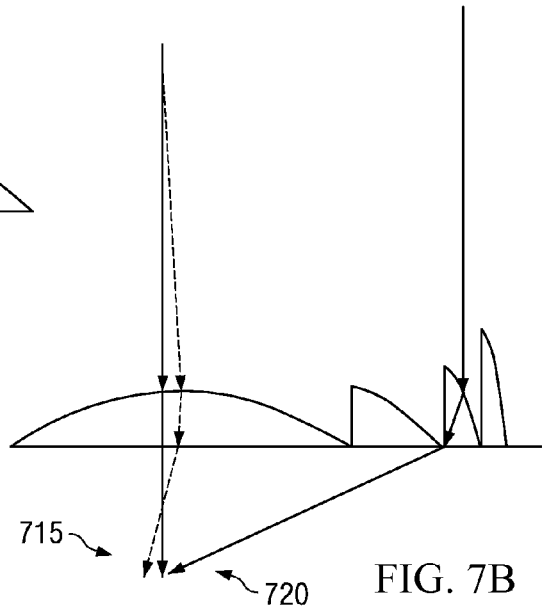

Turning now to FIGS. 7A and 7B, illustrated are the properties of a conventional and fast fresnel lens ("FFL") constructed in accordance with the principles of the present invention. More specifically, FIG. 7A illustrates an embodiment of the focusing element of a SAL employing a conventional convex lens. The small volumes require fast optics which are usually expensive. Also, linear outputs are hard to achieve with fast optics or low cost, and nearly impossible with both. Point 710 illustrates a correct focus point and point 705 illustrates error in the lens' focusing ability. For reasonable angles, this error is often quite small.

Turning now to FIG. 7B, illustrated is an illustration of an embodiment of the present invention employing a FFL. A fresnel lens is a type of lens invented by Augustin-Jean Fresnel and originally developed for lighthouses, as the design enables the construction of lenses of large aperture and short focal length without the weight and volume of material which would be required in conventional lens design. Compared to earlier lenses, the fresnel lens is much thinner, thus passing more light. Note that it is often constructed with separate concentric ridges. This innovative approach provides reductions in weight, volume, and cost. A point 720 illustrates a correct focus, wherein a point 715 illustrates an error in the FFL's ability to provide a correct focus. Though this lens is smaller and lighter, the error in correct focus, even for small angles off boresight is not insignificant.

An alternative embodiment that specifically addresses the focus errors discussed above for a FFL is to add lens stopping (i.e., optical barriers) in those regions where unwanted energy is most likely to originate. This slightly reduces the amount of light passed on by the lens, but also significantly reduces the focusing error for a net gain in performance.

Figure 8:
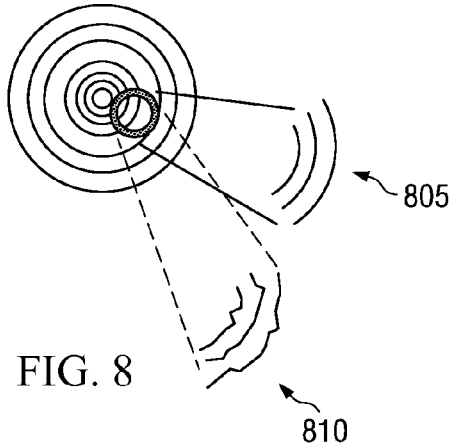
FIG. 8 illustrates a diagram of an embodiment of a pseudorandom pattern for a FFL constructed in accordance with the principles of the present invention.

Yet another embodiment of this invention is to replace the concentric circles of the FFL with randomized circles as illustrated in FIG. 8. Fresnel lens boundaries between surfaces are well known sources of some of the problems illustrated above. Concentric circles 805 are typical of this problem. By innovatively using a pseudo-random walk to define the boundaries, instead of concentric circles, the scattering is much more random, resulting in a less focused scattering pattern and therefore focusing errors are less likely to constructively interfere. Thus, the fast fresnel lens is formed from multiple substantially concentric circles to which is added a pseudo-random walk that results in small local perturbations of a respective substantially concentric circle. In other words, the fast fresnel lens is formed from multiple substantially concentric circles that include random perturbations 810. Additionally, for lenses that are cast, rather than ground, there is no need for the lens surface boundaries to be circular. Yet another embodiment of this invention is to introduce multi-element hybrid optics employing both conventional and hybrid optics.

Figure 9A:
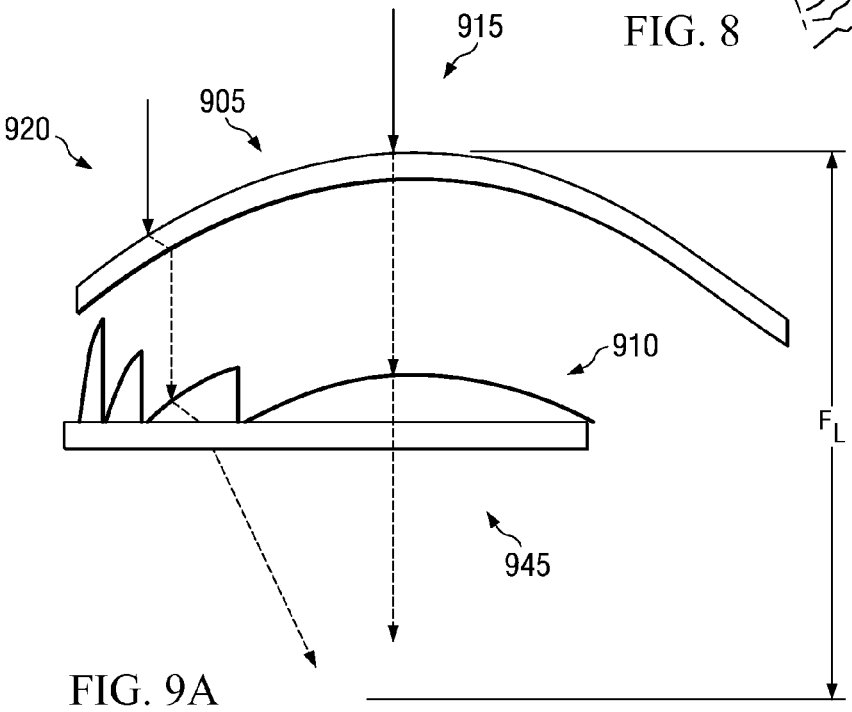
FIGS. 9A and 9B illustrate views of an embodiment of hybrid optics employable with a guidance section of a weapon constructed in accordance with the principles of the present invention.
Figure 9B:
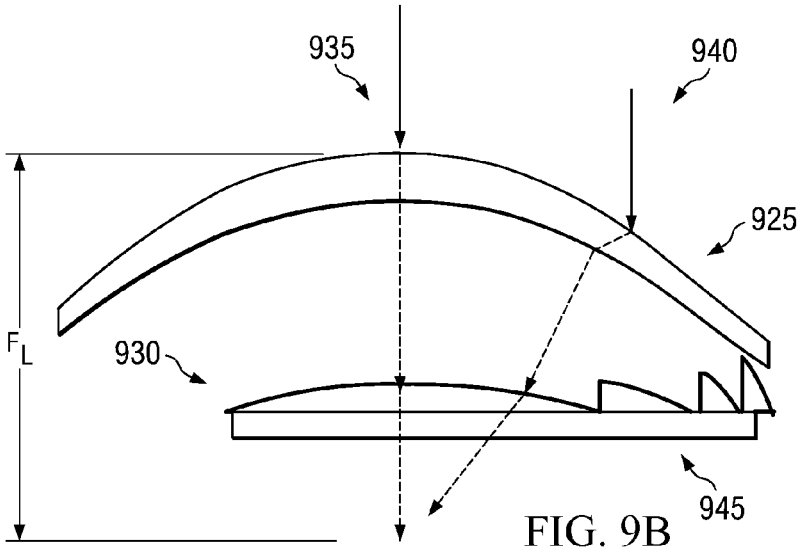

Turning now to FIGS. 9A and 9B, illustrated are views of an embodiment of hybrid optics employable with a guidance section of a weapon constructed in accordance with the principles of the present invention. FIG. 9A illustrates an embodiment employing a clear front lens 905 with no optical properties other than being transparent at the optical wavelength of interest. The focusing is accomplished by a FFL 910 as illustrated by rays 915, 920 where it can be seen that no focusing is accomplished by the clear front lens. Contrast this with the embodiment illustrated in FIG. 9B where a front lens 925 of a target sensor of the guidance section, in concert with a FFL 930 focuses the incoming optical signals 935, 940 and, in so doing, generates a shorter focal length $F_L$ than was generated in FIG. 9A for the same use of volume. The front lens 925 provides a cover to protect the target sensor from environmental conditions and the FFL 930 behind the front lens 925 cooperates with the front lens 925 to provide a multi-lens focusing system for the target sensor.

Therefore, by placing a small amount of optical focusing power in the front lens 925, the focal length of the FFL 930 is allowed to be longer, making it easier to manufacture, while the optical system of FIG. 9B has the desirable property of a shorter focal length. Also, for clarity, note that the drawings of the FFL are not to scale. These lenses often are composed of hundreds of very small rings that are familiar and commonly known to those skilled in the art. Thus, a hybrid system as described herein employs less glass with additional favorable properties of less weight and optical loss. Finally, yet another embodiment is to use the back planar surface of the FFL 930 as a location for an optical filter 945 for filtering of unwanted wavelengths, for example most of the solar spectrum. An embodiment of the invention is an integral aft section, tail fin, actuators, and prime power.

Figure 10:
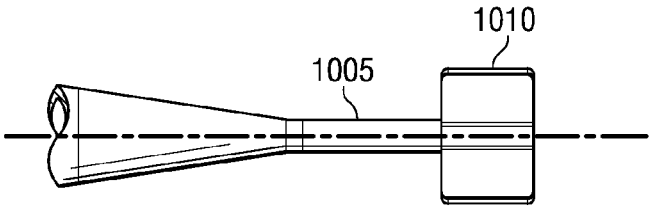
FIG. 10 illustrates a view of an embodiment of an aft section constructed in accordance with the principles of the present invention.

Turning now to FIG. 10, illustrated is a view of an embodiment of an aft section constructed in accordance with the principles of the present invention. More specifically, FIG. 10 illustrates an aft section showing the location of a battery and linear actuators 1005, and each single piece tail fin 1010 to which is attached an axel and linkage level connector. The power elements including batteries used in this application comprehend military batteries, but also include commercial types. As an example, lithium batteries are both light and have a considerable shelf life.

Figure 11:
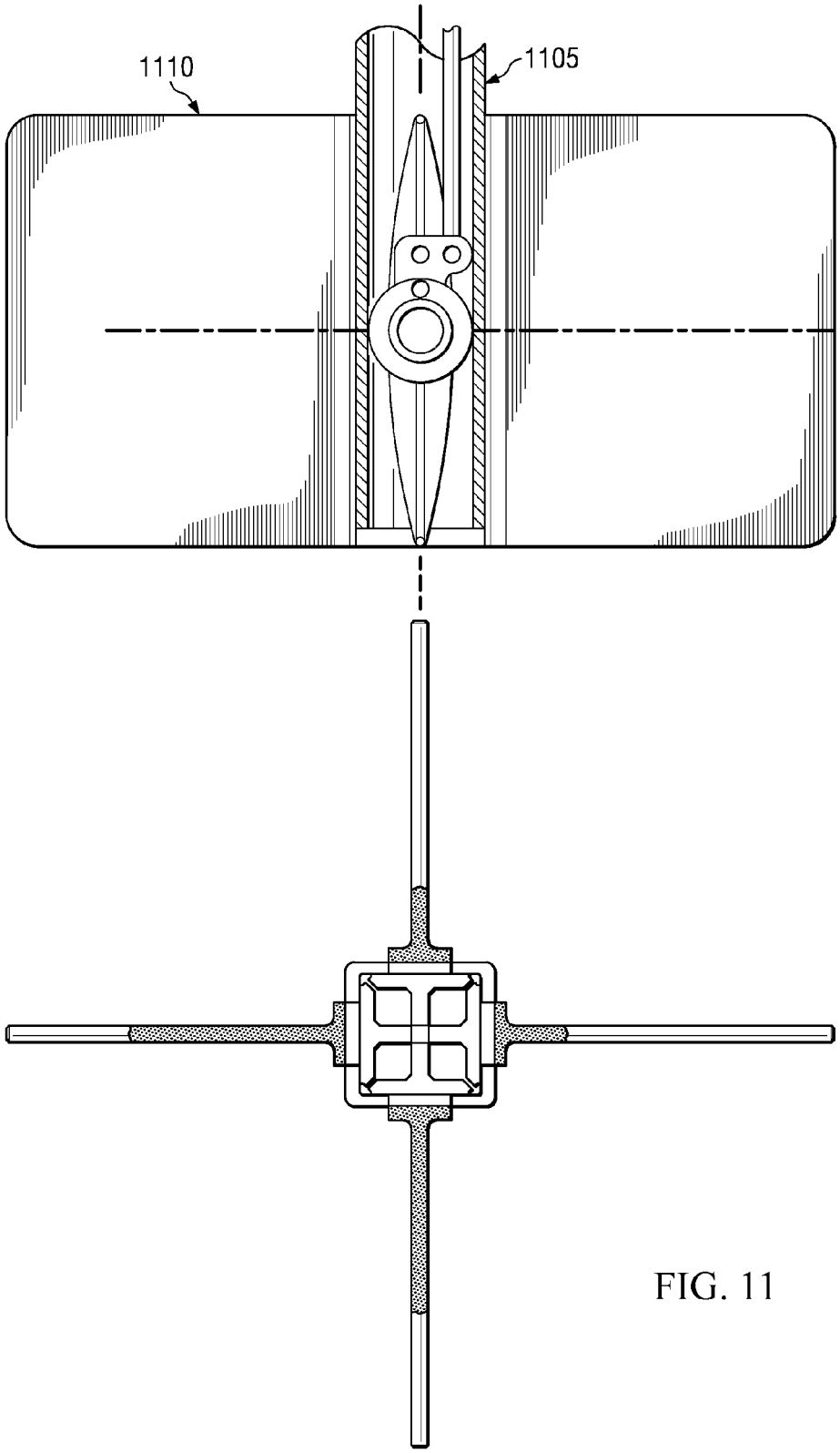
FIG. 11 illustrates a view of an embodiment of an aft section constructed in accordance with the principles of the present invention.

Turning now to FIG. 11, illustrated is a view of an embodiment of an aft section constructed in accordance with the principles of the present invention. More specifically, FIG. 11 demonstrates additional tail fin detail. This innovative design is based on near zero hinge moments and can use linkages and be subjected to forces consistent with radio controlled ("RC") models. Note that the linear actuator fits directly into the tubular aft section 1105. In one embodiment, each of two pairs of tail fins 1110 operate in tandem while in an alternative embodiment, each fin is an independent moving surface. Under certain circumstances, of varying flight conditions, there are advantages to be gained in flight performance by changing the aspect ratio of the wings. This capability is typically relegated to larger aircraft, but this invention comprehends an innovative implementation of providing variable aspect ratio in a very limited space.

Figure 12B:
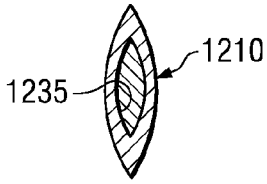
FIGS. 12A and 12B illustrate views of an embodiment of a variable aspect wing ratio for the tail fins of an aft section constructed in accordance with the principles of the present invention.
Figure 12A:
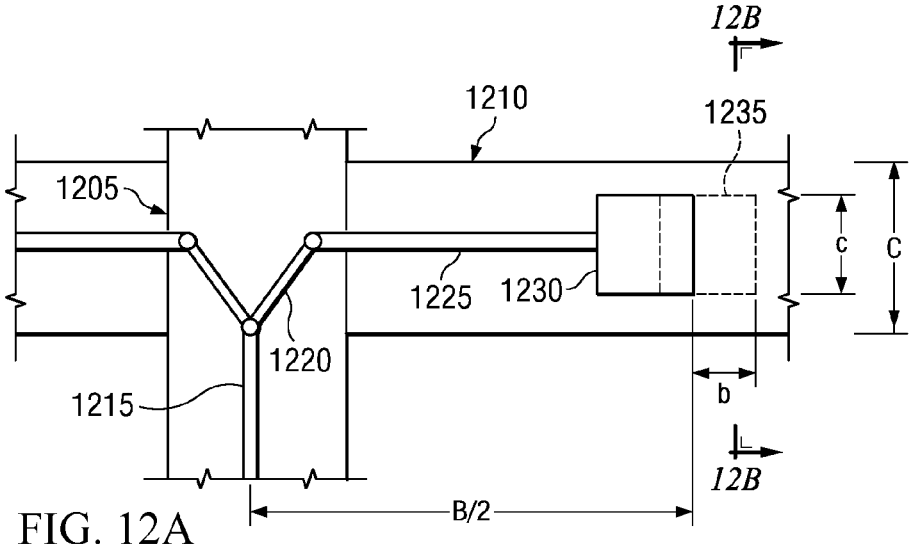

Turning now to FIGS. 12A and 12B, illustrated are views of an embodiment of a variable aspect wing ratio for the tail fins of an aft section constructed in accordance with the principles of the present invention. In this embodiment, a rear fuselage 1205 and tail fins 1210 contain a rod 1215 that moves in a direction, back and forth, along the centerline of the rear fuselage. This causes links 1220 to force rods 1225 along the centerline of the tail fins 1210 in a direction that is normal to rod 1215. In so doing, surface 1230 is retracted and extended as illustrated by extendable surface 1235. An end view (see FIG. 12B) of the tail fin 1210 along with the extendable surface 1235 is also illustrated. Therefore, with surface 1230 retracted, using formulas familiar to those skilled in the art, the aspect ratio A, defined as the ratio of the span of the wings squared to the wing planform (e.g, shape and layout of the tail fin) area is A=((2(B/2))^2)/(B*C). With the extendable surface 1235 extended as shown, the aspect ratio becomes A=((2*((B/2+b)^2)/(B*C+2*b*c), thus clearly showing a change in aspect ratio. Thus, the tail fin 1210 has a modifiable control surface area, thereby changing an aspect ratio thereof. An alternative embodiment using spring steel plates is also comprehended by this invention as discussed below.

Figure 13B:
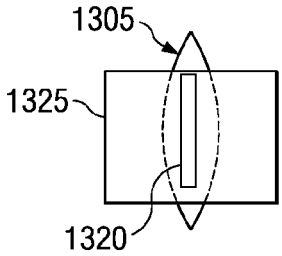
FIGS. 13A to 13F illustrate views of an embodiment of a variable aspect wing ratio for the tail fins of an aft section constructed in accordance with the principles of the present invention.
Figure 13A:
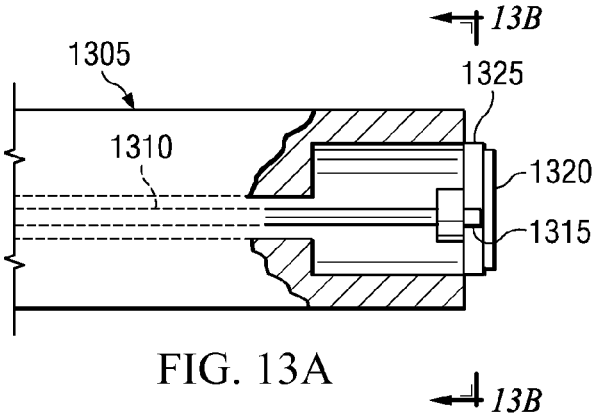
Figure 13C:
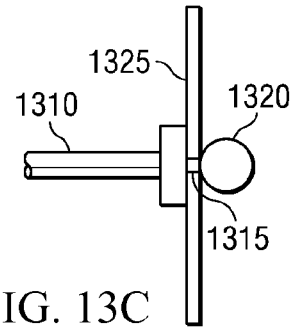
Figure 13D:
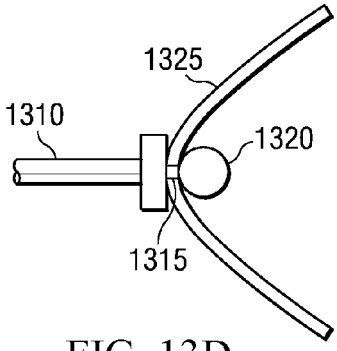
Figure 13F:
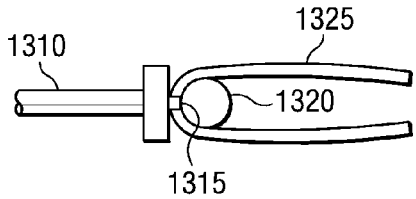
Figure 13E:
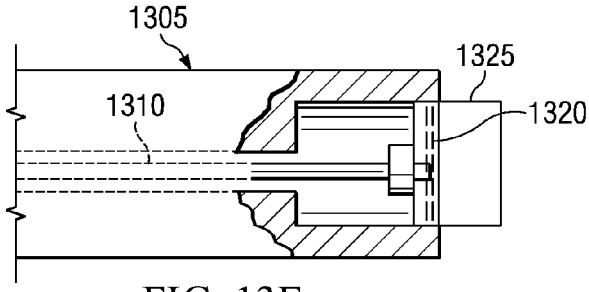

Turning now to FIGS. 13A to 13F, illustrated are views of an embodiment of a variable aspect wing ratio for the tail fins of an aft section constructed in accordance with the principles of the present invention. More specifically, FIG. 13A illustrates a planform view of a tail fin 1305 with a cutout including a rod 1310 that moves in a manner similar to that illustrated in FIGS. 12A and 12B, except that in this embodiment the variable surface is replaced by a deformable surface (e.g., spring steel sheet 1325) shown in the end view of FIG. 13B in an extended status. The spring steel sheet 1325 is coupled to the rod 1310 via a pin 1315 and dowel 1320 as illustrated in FIG. 13C, which provides a front view without the tail fin. Thus, by moving the rod 1330, variable aspect ratio is achieved again in a very confined space. As illustrated in FIG. 13D, the spring steel sheet 1325 is partially retracted to modify the control surface area of the tail fin (not shown in this FIGURE). Finally, FIG. 13E illustrates a planform view of the tail fin 1305 having a cutout with the spring steel sheet 1325 retracted thereby further modifying the control surface area of the tail fin 1305 and changing an aspect ratio thereof (see, also, FIG. 13F, which illustrates a front view with the tail fin removed). Thus, the tail fin 1305 has a deformable surface 1325 coupled to a rod 1310, pin 1315 and dowel 1320 configured to extend or retract the deformable surface 1325 within or without the tail fin 1305.

Figure 14A:
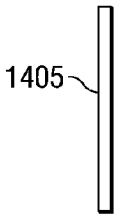
FIGS. 14A to 14D illustrate views of another embodiment of a weapon including the tail fins of an aft section thereof constructed in accordance with the principles of the present invention.
Figure 14B:
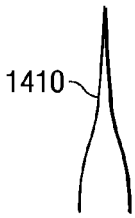
Figure 14D:
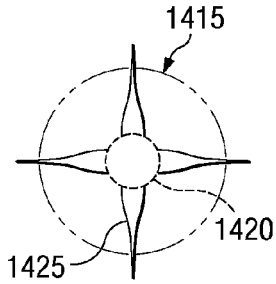
Figure 14C:
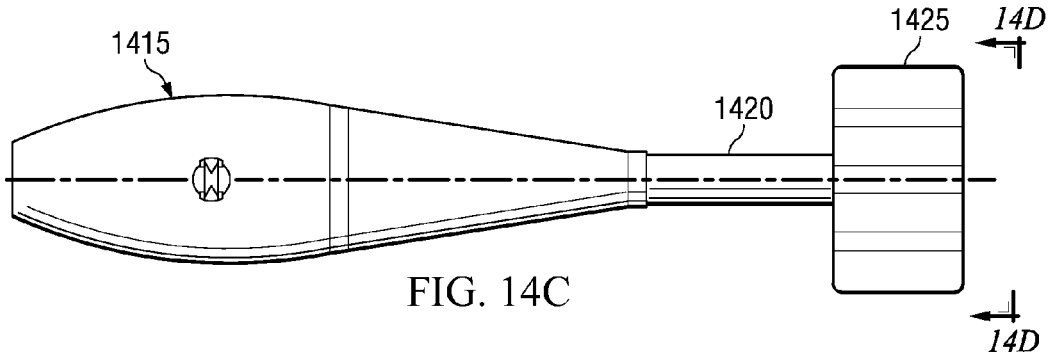
Figure 15A:
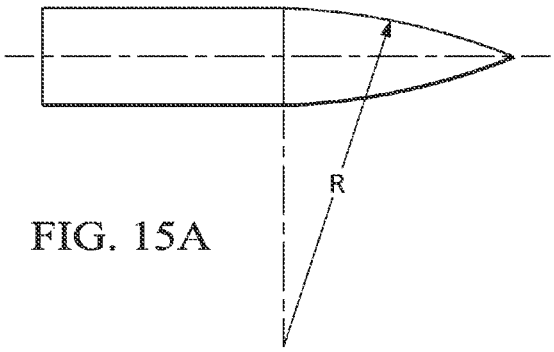
FIGS. 15A to 15D illustrate side views of embodiments of nose cones of a warhead of a weapon in accordance with the principles of the present invention.
Figure 15B:
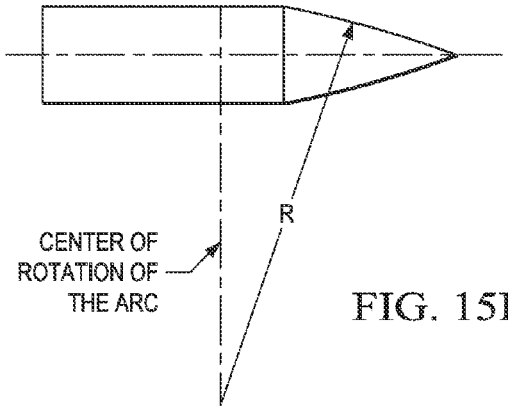
Figure 15C:
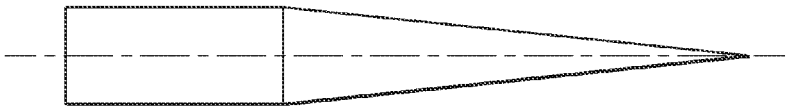
Figure 15D:
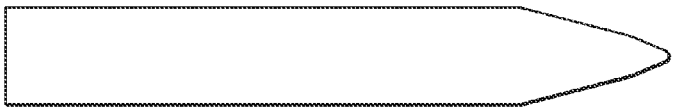

Yet another embodiment of variable aspect ratio is also comprehended by this invention wherein the tail fin dimensions may not change in flight. Referring now to FIGS. 14A to 14D, illustrated are views of another embodiment of a weapon including the tail fins of an aft section thereof constructed in accordance with the principles of the present invention. FIG. 14A illustrates an end view of a present tail fin 1405. For reliability and strength, it may be desirable to change its shape, however, in doing so, the aerodynamic characteristics of the tail fin 1405 may also change dramatically. Therefore, FIG. 14B of the weapon 1415 includes a variably shaped tail fin 1410 that does not vary the aerodynamic characteristics of the tail fin and therefore the weapon. This is because the body of the weapon 1415 as illustrated in FIG. 14C is large with respect to the cylindrical area of the tail section 1420, thereby prohibiting much of the airflow around the tail fins at their base. The end view of FIG. 14D illustrates the shaped tail fin 1425 with characteristics of the flat fin outside the diameter of the weapon body and also showing additional mass and therefore strength in that area of the fin that is not active due to body shading.

In accordance with a guidance section, a target sensor (also referred to as a seeker such as a laser seeker) detects energy that provides directional information to guide a weapon to a target. The seekers may be "active" emitting energy as in the case of radar, "passive" as in the case of a weapon using a television image based on natural illumination, or "semi-active" as in the case of laser guided bombs, wherein a laser spot designates the target. The weapon as described herein may employ active, passive or semi-active seekers. Additionally, the seeker as described herein takes into account arbitrary aerodynamic shapes without compromising the optical objective apertures and is consistent with the ongoing pressures for reduced cost, weight and volume.

Guided weapons were first used in World War II and, late in the war, Germany, the United States and others were developing and deploying the first guided weapons with "terminal guidance" or a "seeker" to attack moving targets, or to arrive at an aim point with a small miss distance. These early systems, such as the German "Fritz-X" and the allied special weapons ordnance device ("SWOD") MK-9/air-to-surface missile ("ASM")-N-2 "BAT" are recognizable as guided weapons with functional block diagrams similar to those in service today.

However, the size and weight of the elements is remarkably different. The BAT is considered by many historians to be the first true fire and forget guided weapon with a seeker unaided by an operator and data link. The BAT is exemplary of seeker trends and challenges. The BAT weighed roughly 1000 kilograms ("kg") and had a wingspan of about 3 meters. Roughly 40% of the weight of the system was not the warhead. The BAT used three large lead acid batteries as a power source. These were much larger than the batteries commonly found in automobiles today, so just the power source for BAT was larger than some modern guided weapons such as the TOW or Javelin (Javelin weighs less than 30 kg).

The components of guided weapons have seen remarkable reduction in size and cost. The Javelin, with a warhead weight of less than 10 kg can penetrate more than half a meter of armor, a feat that would have required a warhead mass at least ten times greater in 1950. The signal processing electronics in the BAT relied on less than 20 vacuum tubes. Each tube was roughly a thousand times larger and used roughly a thousand times more power than one modern digital signal processor ("DSP"). So, components other than the seeker have seen four orders of magnitude, or more reduction in size and, in many cases, the costs have fallen dramatically as well.

Thus, the state of the art seekers' performance can be changed in response to modern objectives. In particular, the need to package seekers based on demands of airframes' allowance for weight (e.g., less than 1 kg), volume (e.g., less than 0.1 liters) and outer mold line have become quite challenging. In the past, the leading edge of the weapon was generally a compromise between airframe needs and the design constraints of the seeker. For instance, the flight and guidance times have been reduced from a minute to 10 seconds and the accuracy is critical to the reduction of warhead size and collateral damage. The seeker as described herein eliminates many of the past compromises.

Semi active laser ("SAL") seekers are among the simplest of weapon guidance devices. SAL seekers employ parabolic optical lenses and limited integration (e.g., Hellfire has electronic counter-countermeasures ("ECCM") in a separate chip and Paveway III has gyros on its gimbals as well as body fixed gyros). Also, the SAL seekers employ functional separation such as sensor stabilization separate from line-of-sight ("LOS") estimation and error correction (if any) is performed by additional optical elements (see, e.g., U.S. Patent Application No. 2007/0187546 entitled "Binary Optics SAL Seeker (BOSS)," to Layton, published Aug. 16, 2007, which is incorporated herein by reference. Generally, such seekers operate at only one or two optical wavelengths, and have detectors with as few as four elements. They are found in the least expensive guided weapons, such as laser guided bombs. While these systems have provided much of the stimulus for low cost, they have also continued to demonstrate many of the compromises discussed previously. Similar examples can be given for other classes of seekers. However, since even the most basic seekers demonstrate these undesirable attributes, it will be apparent to those skilled in the art that more sophisticated seekers also manifest these attributes.

Turning now to FIGS. 15A to 15D, illustrated are side views of embodiments of nose cones (e.g., tangent, secant, true and blunt ogive nose cones, respectively) of a warhead of a weapon in accordance with the principles of the present invention. Basic ogives were used in rifled ammunition before the American Civil War and by both sides during the Civil War (for example, many Mason & McKee bullets). The shapes of this class include relatively simple classic ogives, as shown here, and more complex forms, such as the von Kármán Ogive. A summary of geometry of these bodies can be found at the web site of Virginia Tech (http://www.aoe.vt.edu/~mason/Mason_f/CAtxtAppA.pdf, which is incorporated herein by reference), wherein a summary of geometry for aerodynamicists is presented.

While the bodies presented may be well defined by algebraic equations, the considerations that determine these shapes is aerodynamic, and the effect of the shape on electromagnetic energy, that may need to pass through a transparent window in the nose or forepart, is often not a consideration. The shape of these bodies has been a challenge for seeker designers, and a number of compromises have been required to deal with the challenges. Some of the compromises are unsatisfactory and create significant system costs in terms of price, weight, performance, or other costs. Moreover, theoretical shapes are idealized representations of systems that can be practically realized. For this reason, these shapes are sometimes called ogvial, or near ogive.

An arc of rotation is often used to describe an ogive. A formula is useful for modern machining and analysis methods. The formula for a tangent ogive is shown below, wherein x, y are coordinates, x being along the length of the cone, and y being the height (or radius) of the cone taken from the centerline of the cone.

$$\bar{y} = \sqrt{\left(d\left(C^2 + \frac{1}{4}\right)\right)^2 - x^2} - \left(d\left(C^2 - \frac{1}{4}\right)\right)$$

The caliber of the cone is C=L/d, wherein L is the cone length and d is the cone base diameter.

A number of practical factors should be considered in the design of a nose shape. Examples of nose shapes include bi-conic, spherically blunted cones, spherically blunted ogives, HAACK, elliptical ogives, parabolic (which generally has a sharp tip similar to a tangent ogive), and so called power series (which often produces the best result in terms of drag). Some of these shapes are more practical than others. In addition, mission requirements such as the need for a fuzing crush switch (e.g., for contact fuzing) on or near the nose, or the need to provide for penetration kinematics can also be factors in the final design. So, it should be clear that a wide range of factors (aerodynamics, manufacturing processes, environmental demands, fuzing, penetration) should come to bear in the selection of the nose shape of a guided missile, and that optical (or antenna) issues cannot be the sole design criteria for selecting the shape, material and other nose features. Those skilled in the art will recognize that the factors described here are exemplary and not an exhaustive list. Clearly, a seeker approach that accommodated non-optical (or antenna) concerns would be very useful.

Figure 16A:
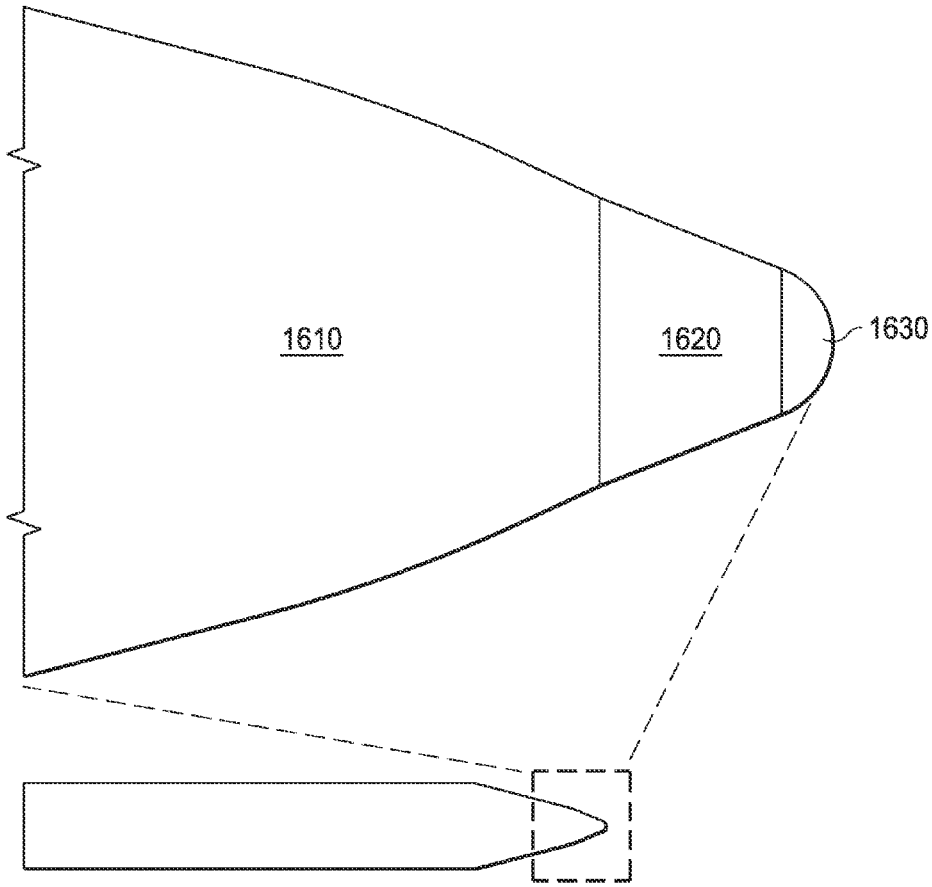
FIGS. 16A and 16B illustrate exploded views of an embodiment of a nose cone of a warhead of a weapon in accordance with the principles of the present invention.
Figure 16B:
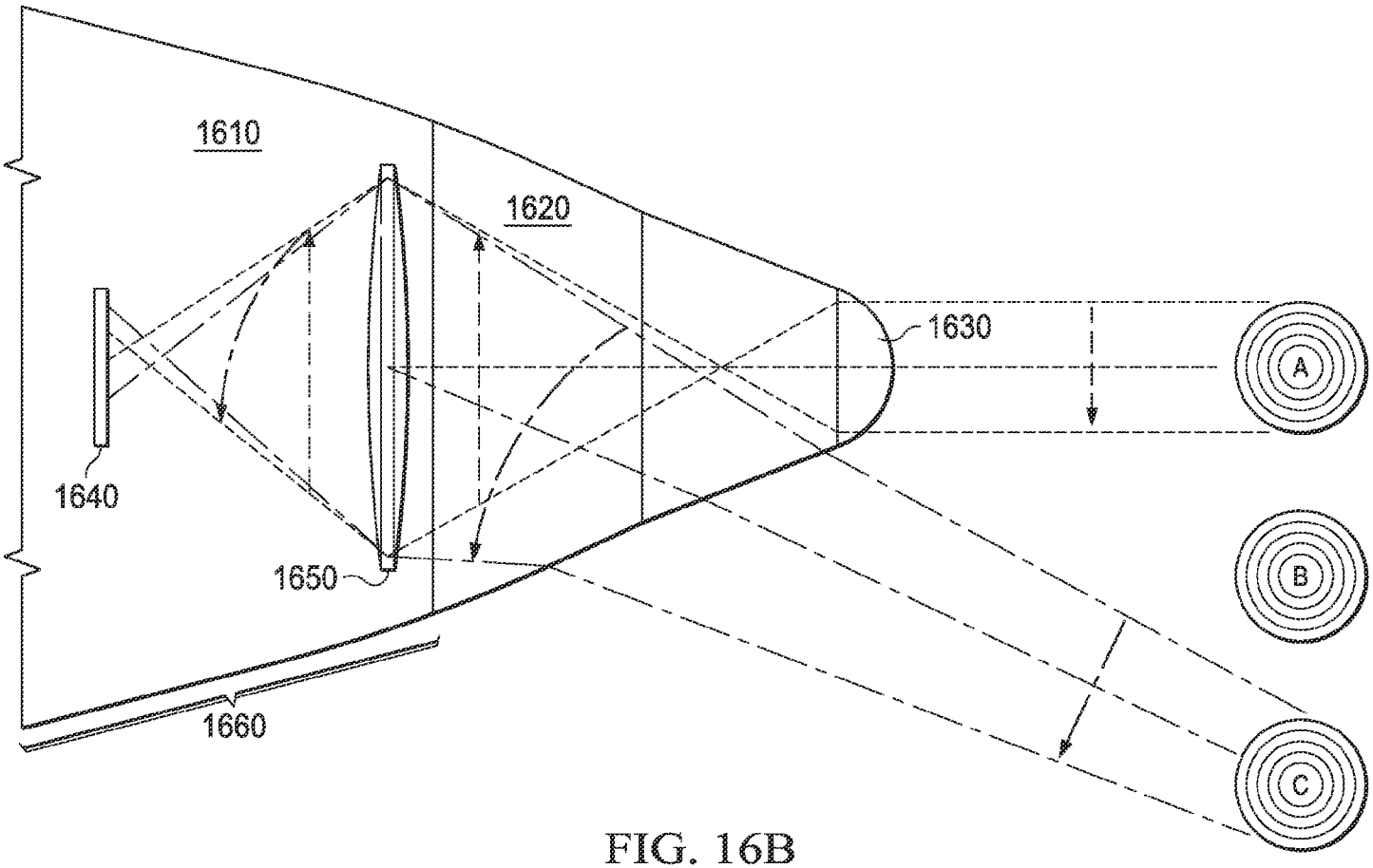

Turning now to FIGS. 16A and 16B, illustrated are exploded views of an embodiment of a nose cone (e.g., a blunt ogive nose cone) of a warhead of a weapon in accordance with the principles of the present invention. The nose cone includes a shaped region or section 1610 defined by a selected ogive or other shape (e.g., von Kármán Ogive) with fineness ratio determined by mach regime and payload considerations. The nose cone includes a transition region or section 1620 defined by a section of a true cone between the regions thereabout. The nose cone also includes a forward region or section 1630 with a diameter determined by nose cone material strength, mach regime, thermal characteristics and other considerations.

As illustrated in FIG. 16B, the forward section 1630 of the nose cone, which is transparent to the electromagnetic energy being sensed, can interact very differently with targets that are off bore sight to varying degrees (e.g., due to lensing effects or other aberrations in the nominally transparent material) to the extent that there may not be a one-to-one manifold between target line-of-sight and an output of a detector 1640. In the example shown, target A is only influenced by the spherical region of the seeker window. Depending on the dimensions of a hemi dome, and the index of refraction, and on other characteristics, a target in this region may be inverted as shown by the dashed arrows associated with the target A ray tracing. Note that the target A image is not in sharp focus because in this exemplary embodiment, a SAL seeker is depicted. The SAL seekers typically involve a degree of intentional defocus. Target A is relatively undistorted and the seeker designer would select the hemi-dome to be a parabolic section, rather than a spherical section, as a modest compromise between optical performance and aerodynamic theory.

In contrast, target C is not inverted by the nose cone, but because the geometry of the regions presents different angles of incidence to incoming rays, the resulting dashed arrow associated with target C is bent or distorted. As the maneuverability of guided weapons has increased, the importance of these considerations has increased because of the need to achieve high angles of attack, and to attack targets far from bore sight. If a ray is traced for target B, it would be influenced by all three regions. Note that significant errors have been introduced before an objective lens 1650. The optical train that begins with the objective lens 1650 and ends with a sensor of some type, will also have limitations such as imperfect collimation. As errors propagate and compound, it can be difficult or even impossible to generate useful guidance signals.

It is clear to those skilled in the art that complex nose shapes and large line-of-sight angles pose a challenge to the seeker designer. Further, the need to provide for a very large window, forward of an opaque region 1660 can be quite costly and in some applications materials with the right combination of thermal, optical, and structural characteristics can cause the dome to be the most expensive component in the seeker, if the design can be realized at all.

Figure 17:
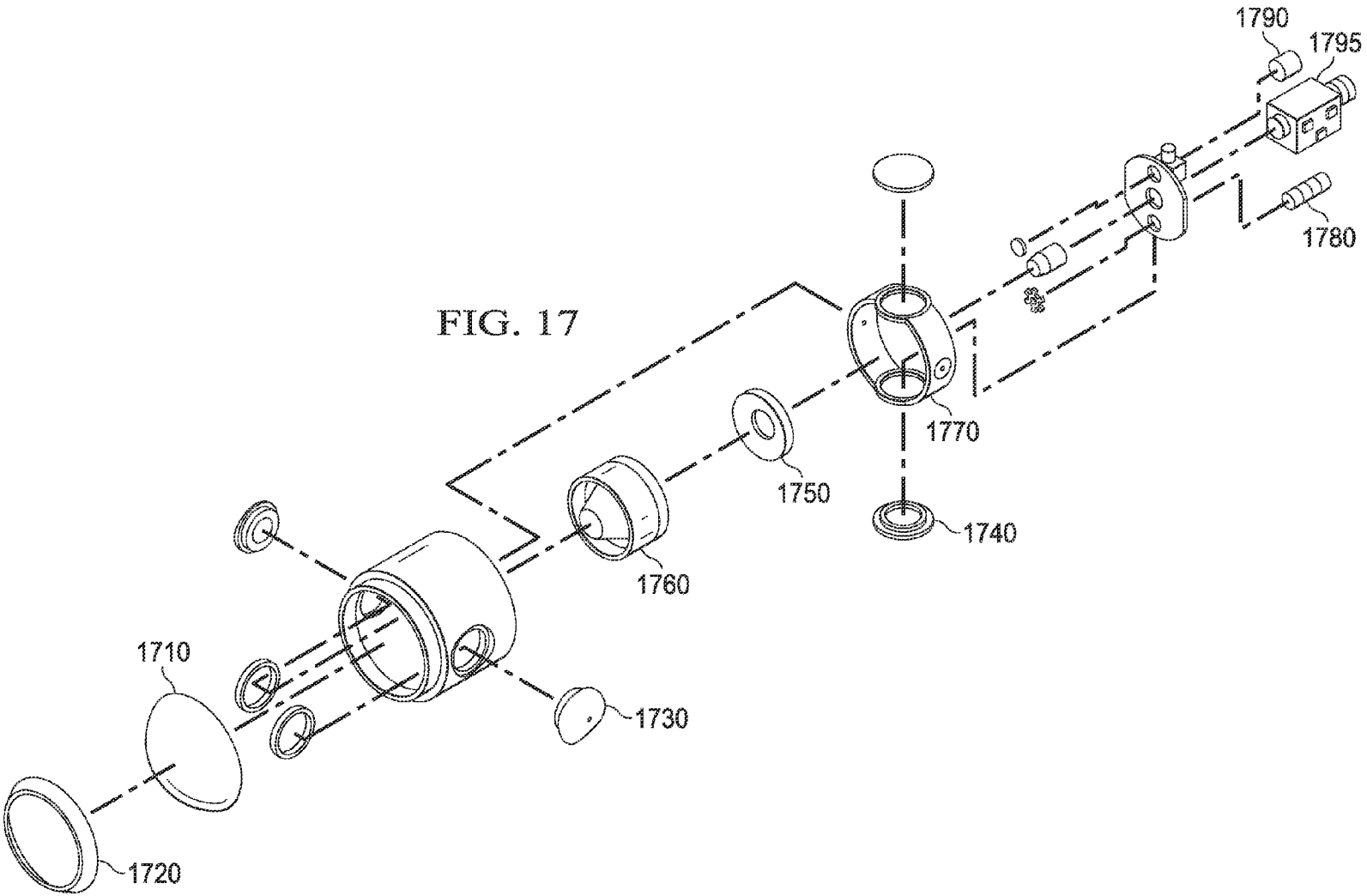
FIG. 17 illustrates an isometric view of an embodiment of a seeker.

Turning now to FIG. 17, illustrated is an isometric view of an embodiment of a seeker employing a catadioptric optical system and a two axis gimbal set, with onboard gyroscopes for stabilization and line-of-sight measurement. The seeker includes a dome 1710 (with a dome retainer ring 1720), an el and az trunnion assembly 1730, 1740 about primary and second mirrors or lens 1750, 1760, a gimbal ring or gimbal 1770, a gyro 1780, a calibration motor 1790 and a focal plane array ("FPA")/dewar assembly 1795. In this case, a cryogenically cooled focal plane array resides on the gimbal 1770, so the cryogenic system moves with the gimbal 1770. Note that the seeker's hemi-dome 1710 is different from the types of shapes sought by aero dynamists and occupies nearly the frontal area of the warhead. The seeker shown here is a single mode device. When dual or tri mode seekers are employed more complexity is often the result.

Note that the primary optical aperture (primary mirror 1750) is smaller than the dome 1710. In this case, the primary mirror 1750 is set by the need for optical gain, and a fast f-number. The dome size, however, is set by the need to point the primary mirror 1750 toward the target because the instantaneous field of view is too small to engage all of the needed target geometries. The dome size is also influenced by the dimensions of the telescope assembly and of the gimbal set. If a smaller telescope with a large instantaneous field of view is used, the seeker could be designed with less complexity and cost.

Thus, advantageous characteristics of seekers include a small diameter objective to permit placement as far forward as possible in the warhead and support for line-of-sight angles. Additionally, seekers should support nose shapes determined by aerodynamics, material properties, manufacturing tolerances and cost. Seekers should also employ simple means to correct for optical errors with the need to accommodate multi-mode sensors operating at different wavelengths. It would also be beneficial to avoid complexity and high component counts to include a low number of optical components, no gimbals, simple collimation and simple assembly.

Figure 18A:
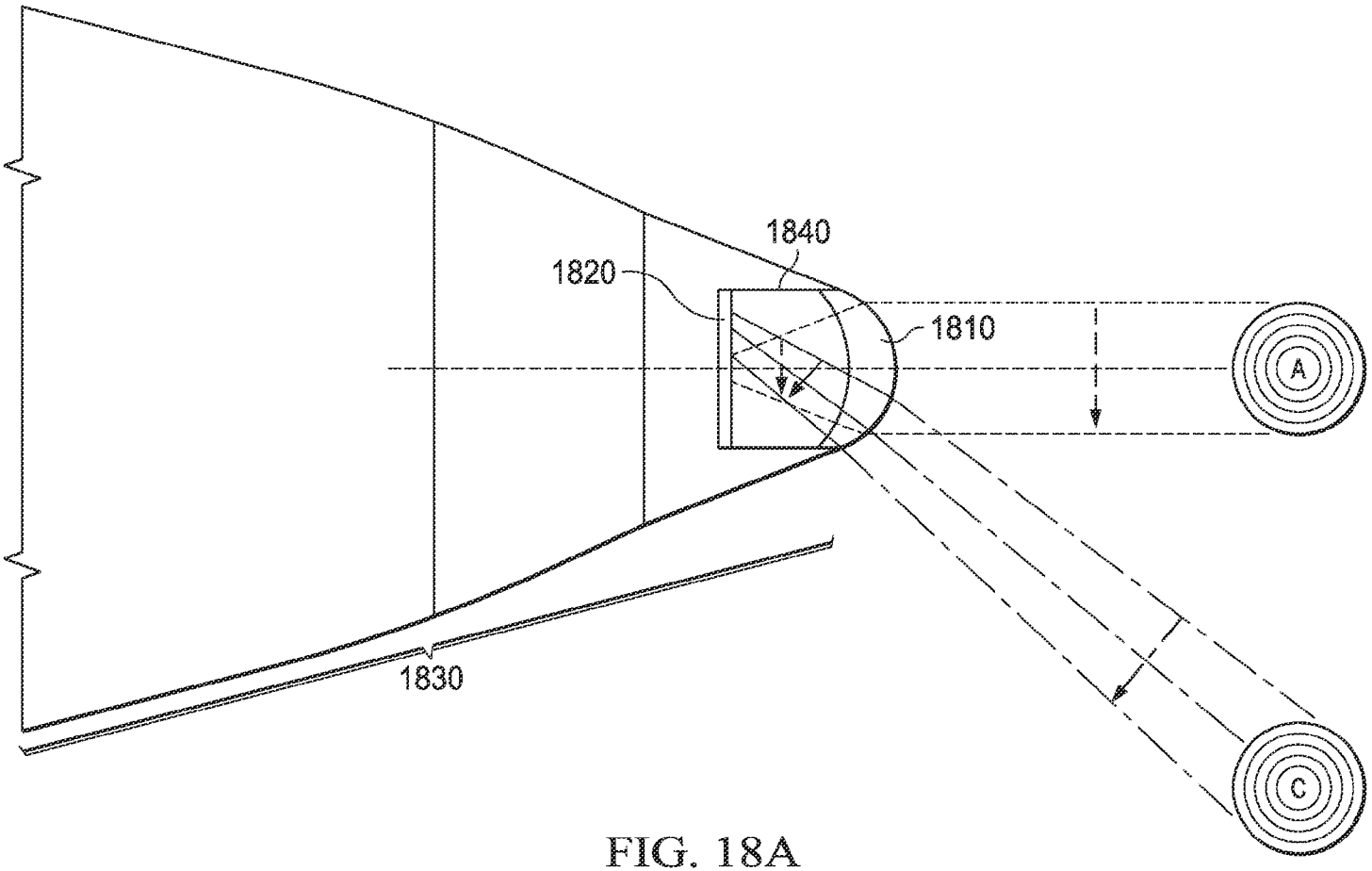
FIGS. 18A and 18B illustrate views of an embodiment of a seeker constructed according to the principles of the present invention.
Figure 18B:
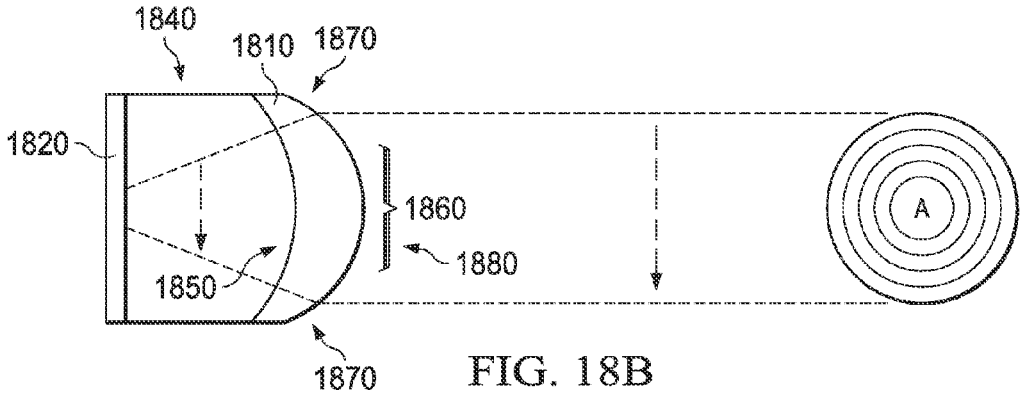

Turning now to FIGS. 18A and 18B, illustrated are views of an embodiment of a seeker constructed according to the principles of the present invention. A spherical section (e.g., a hemi-dome 1810) is an objective lens whose external shape is set by non-optical considerations. The back surface 1850 of the objective lens integrates a number of features as set forth below. For SAL seekers, this implementation is practical because a sensitivity of a detector 1820 is adequate to support primary aperture areas less than the detector area. As illustrated, the area that can be an opaque region 1830 to optical wavelengths is obviously much larger than in the previous embodiment. This supports a variety of other seeker types and, therefore, accommodates dual and tri mode seekers. The seeker also includes a standoff (e.g., a standoff tube 1840) for placing the detector a fixed distance from the hemi-dome 1810, which is practical in view of the correction map described below.

In FIG. 18B, it is more clearly seen that the shape chosen for the hemi-dome 1810 is somewhat arbitrary from the optics designer's perspective. The central region 1860 of front surface 1880 of the objective lens is a flattened cone, and the outer region 1870 is a somewhat sharper cone and is thus termed biconic. The cross section is described by straight lines, not parabolic curves. This is exemplary of the types of choices that aerodynamic heating and manufacturing considerations might dictate, if optics were not considered. The back surface 1850 of the objective lens is a shape chosen by the optics designer to provide a complementary corrective curvature, so that the resulting optical performance roughly matches a more conventional lens. The concept of a complementary corrective curvature will be familiar to laymen whose optometrists have prescribed corrective lens for astigmatism. The lens within the human eye can have distortions, but a complementary correction can provide undistorted vision. For those skilled in telescope design, another example is the common practice of producing catadioptric optical systems with a spherical objective reflector, but correcting for spherical aberration by means of a corrector lens, thus lowering the cost of the overall telescope. Modern optical design software has made practical the design of corrective curvature, whether for eyeglasses, or for telescopes.

Those skilled in the art of optics design will recognize the rough approximation of a classic "fish eye" objective, with a wide field of view, but will also recognize that in addition to typical fish eye distortion, additional distortion has been created by the flattened front surface, and by the practical limits of correction of the back surface. The classic optics approach to solving these problems would be to add additional glass types, creating a doublet or triplet, to add additional elements (either lens or corrective holograms), or some combination of these features. An example of such multi-element approach can be found in Layton introduced above.

Clearly, this approach is much less complex and, therefore, less expensive. For the SAL seeker, it is likely that the objective lens could be cast from a material such as Pyrex and would not need additional polishing, since the seeker does not require sharp focus. This aspect of the seeker, however, taken alone may not provide adequate guidance accuracy for some applications.

Figure 19:
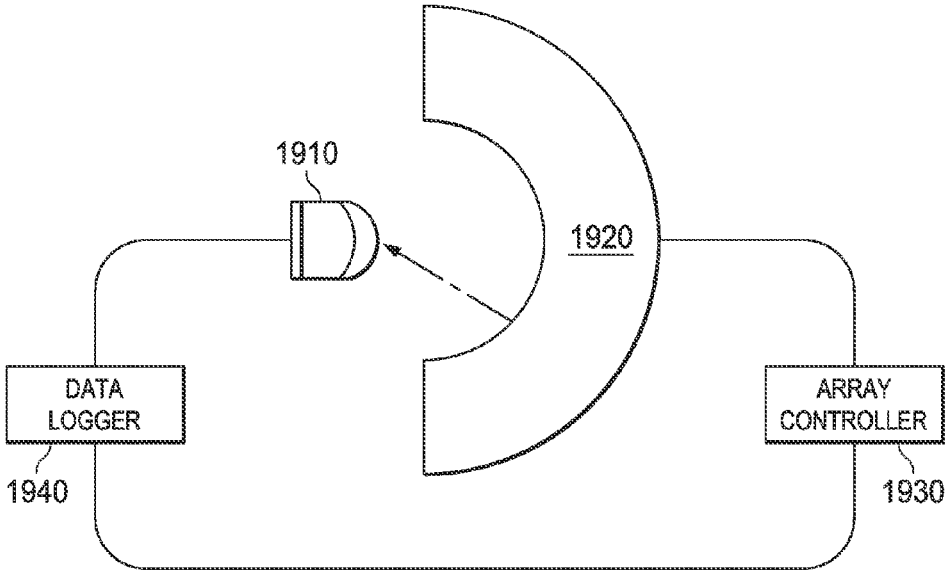
FIG. 19 illustrates a cutaway view of an embodiment of a seeker with a calibration array constructed according to the principles of the present invention.

Turning now to FIG. 19, illustrated is a cutaway view of an embodiment of a seeker 1910 with a calibration array 1920 constructed according to the principles of the present invention. A number of calibration array embodiments are possible including a planar array and the calibration array 1920 may be set up during a manufacturing or calibration stage for the seeker 1910. In this embodiment, a spherical section of the calibration array supports a number of emitters. As each emitter under control of an array controller 1930 illuminates the objective lens of the seeker, a data logger 1940 makes a record of the seeker response to the illumination.

In the illustrated embodiment, the illumination (depicted by the dashed arrow) is 60 degrees off bore sight. By illuminating the seeker from a plurality of locations across the calibration array 1920, a seeker response map can be constructed. By comparing the seeker response map with the known angles of illumination, a seeker correction map can be constructed that render less complex and inexpensive weapons comparable in performance to weapons of higher complexity and cost.

For some sensor types, nonlinear response will dictate that a plurality of maps be constructed to accommodate illumination polarization, intensity and other characteristics. The details of the mapping strategy is dictated by the characteristics of the detector, and of the type of electromagnetic energy detected. However, the primary requirement for the calibration system to provide a useful seeker response map is that the transfer function provided by the optical system from incoming illumination to electrical output be a one-to-one manifold.

Figure 20:
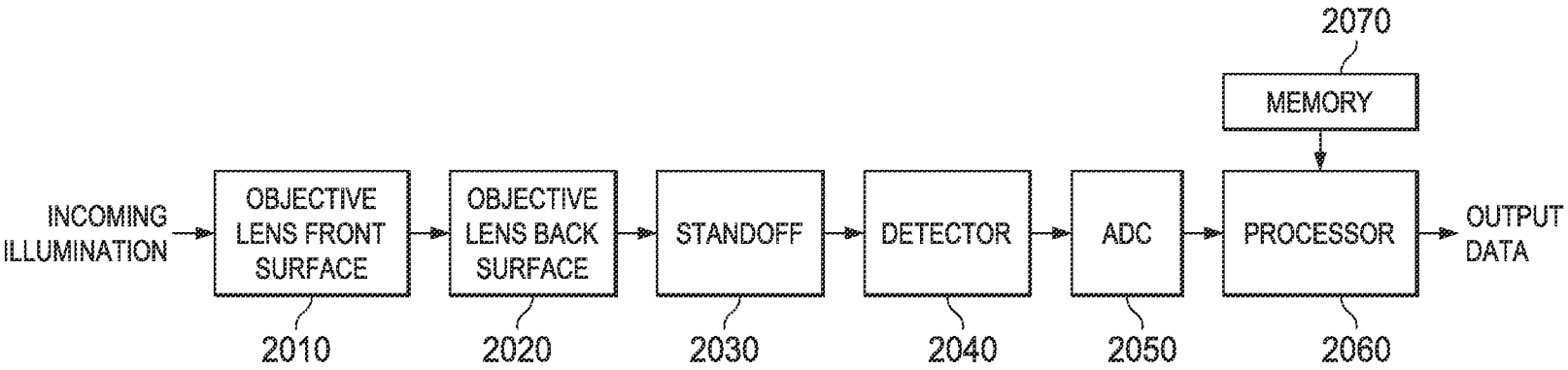
FIG. 20 illustrates a block diagram of an embodiment of a seeker constructed according to the principles of the present invention.

Turning now to FIG. 20, illustrated is a block diagram of an embodiment of a seeker (e.g., a SAL seeker) constructed according to the principles of the present invention. Incoming target illumination (e.g., a distorted signal) impinges on a front surface 2010 of an objective lens, whose shape may be determined by criteria other than optics. The illumination energy passes through the lens material, refracting and exiting via the back surface 2020, whose shape was designed to approximate a corrective shape, correcting for the front surface 2010.

The objective lens is positioned relative to a detector 2040 by a standoff (e.g., a standoff tube) 2030. The detector is illuminated by the energy focused by the objective lens, creating a signal sent to the amplifier and analog-to-digital converter ("ADC") 2050. A processor 2060 in connection with memory 2070 uses specified target criteria (for example, laser pulse to pulse interval) to determine if incoming signals are from a valid target, and uses the correction map to provide a more accurate line-of-sight estimate (i.e., output data including a correction signal to guide a weapon employing the seeker to the target).

The construction of the system shown here will vary with a number factors. For example, subsonic flight permits a wider range of optical materials and nose shapes than transonic or supersonic flight. The detector 2040, objective lens, standoff 2030 and processor 2060 may be manufactured as single unit, so that errors in collimation are included in the correction map, thus lowering the cost and required precision of assembly. In this way, the correction map is integral to the seeker head assembly reducing the chance that a correction map will be associated with the wrong seeker assembly.

The processor 2060 may be of any type suitable to the local application environment, and may include one or more of general-purpose computers, special purpose computers, microprocessors, digital signal processors ("DSPs"), field-programmable gate arrays ("FPGAs"), application-specific integrated circuits ("ASICs"), and processors based on a multi-core processor architecture, as non-limiting examples. The memory 2070 may also include one or more memories of any type suitable to the local application environment, and may be implemented using any suitable volatile or nonvolatile data storage technology such as a semiconductor-based memory device, a magnetic memory device and system, an optical memory device and system, fixed memory, and removable memory. The programs stored in the memory may include program instructions or computer program code that, when executed by an associated processor, enable the seeker to perform tasks as described herein.

Thus, the ones of the modules of the seeker may be implemented in accordance with hardware (embodied in one or more chips including an integrated circuit such as an application specific integrated circuit), or may be implemented as software or firmware for execution by a processor. In particular, in the case of firmware or software, the exemplary embodiment can be provided as a computer program product including a computer readable medium or storage structure embodying computer program code (i.e., software or firmware) thereon for execution by the processor.

Furthermore, the seeker as disclosed herein permits very simple optical tube designs, which can be held in place by means of simple compression and fasteners, avoiding complex optical assemblies or exotic optical adhesives. Embodiments for high mach regimes will vary and may require thermal isolation for the detector 2040 and processing electronics. The seeker typically includes other modules such as a filter to block energy outside the desired band associated with the target designator. In the exemplary embodiment, the filter may include coatings deposited on the back surface 2020 of the objective lens.

Figure 21:
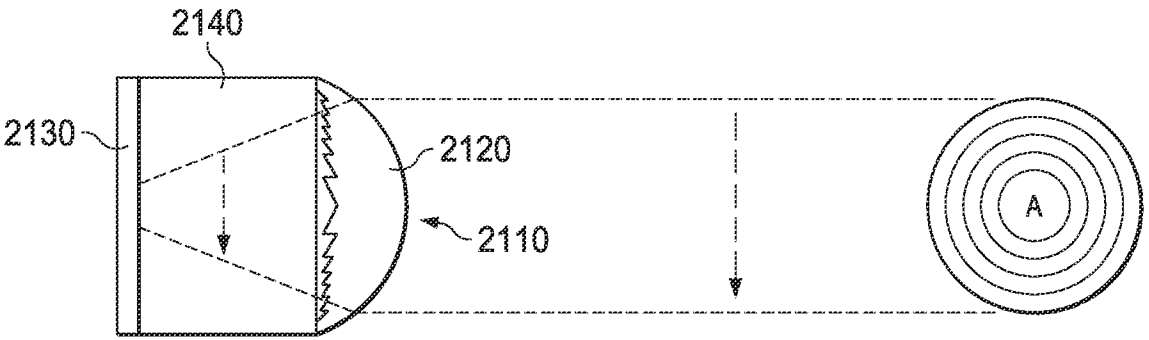
FIG. 21 illustrates a view of an embodiment of a seeker constructed according to the principles of the present invention.
Figure 22A:
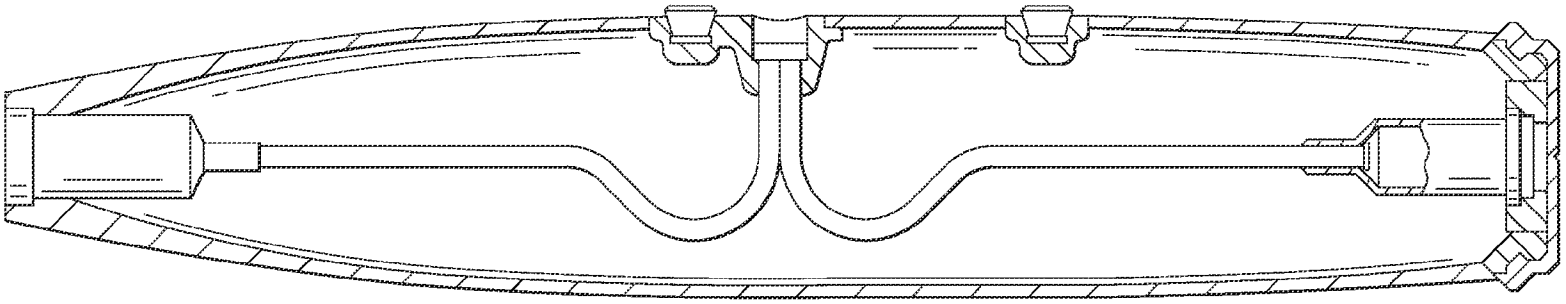
FIGS. 22A to 22D illustrate views of embodiments of warheads of weapons.
Figure 22B:
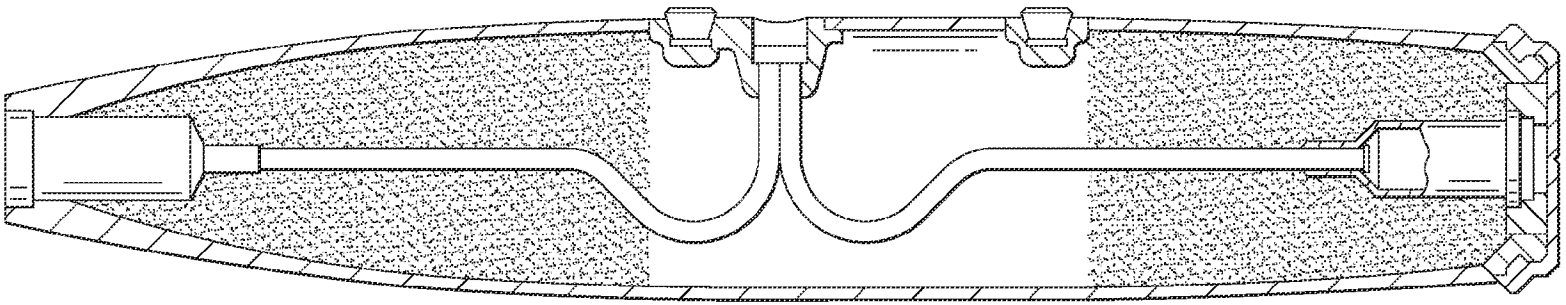
Figure 22C:
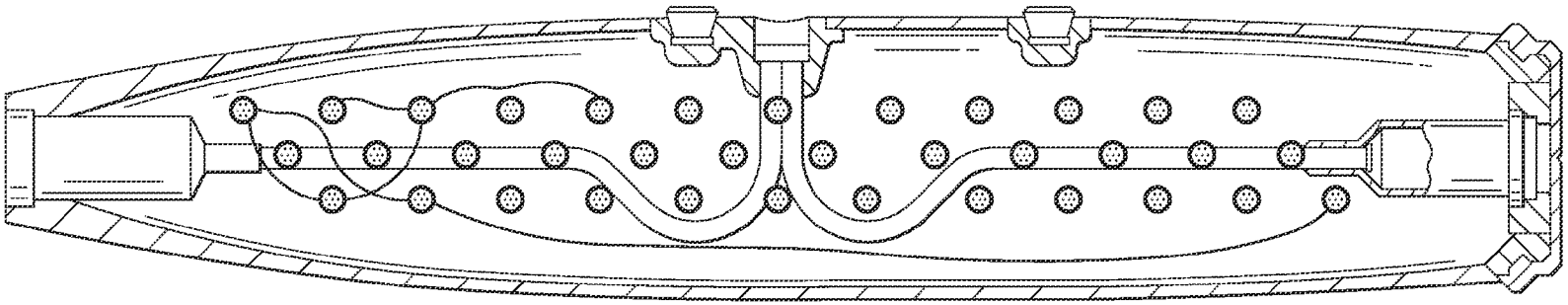
Figure 22D:
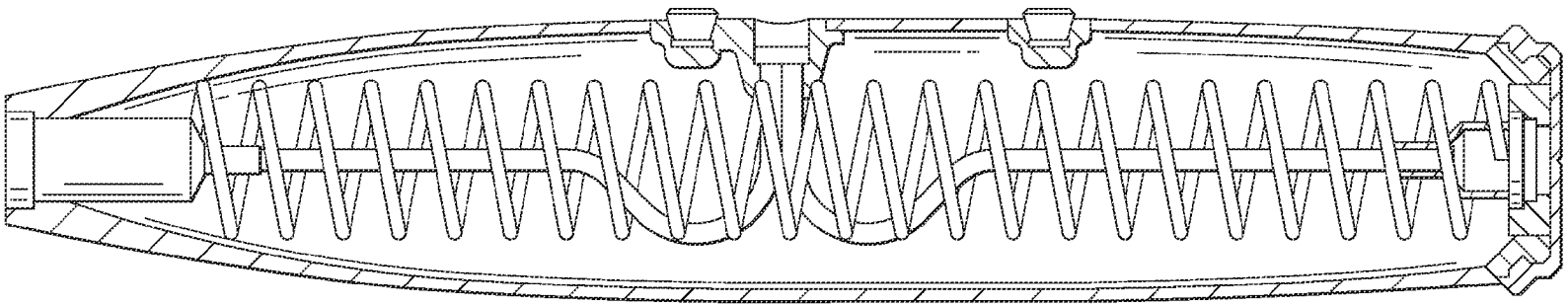

Turning now to FIG. 21, illustrated is a view of an embodiment of a seeker constructed according to the principles of the present invention. The seeker demonstrates a separation of a seeker dome 2110, which provides environmental protection, and an objective lens (e.g., a fast fresnel lens) 2120. In this case, the fast fresnel lens includes the features previously described above. In addition to the detector 2130 and standoff 2140, a calibration system provides a means to develop a correction map, thus generating line-of-sight information for guidance purposes as described above.

As mentioned previously, warheads are increasingly being used near sensitive population and structures wherein the distance between hostile and engaged troops is often less than 200 meters in urban operations and the hazard distance for a typical air delivered munition is more than 200 meters. While some low yield warheads have been successfully demonstrated (e.g., BLU-126, which is partially filled with inert fill before adding the explosive and is a variant of MK-82), there is still a lack of ability to select the level of output or variability once a mission has begun. It would be beneficial to employ a weapon that can provide full warhead output, or can be selectively reduced based on rules of engagement.

Turning now to FIGS. 22A to 22D, illustrated are views of embodiments of warheads of weapons including an MK-80 series bomb, an MK-80 series bomb with multiple fills, an MK-80 series bomb with multiple moderation and an MK-80 series bomb with spiral cutter, respectively. The illustrated warheads create a shaped charge jet ("SJT") that may compromise the warhead case, explosive charge or both. The multiple fills have been used, in some cases with combination of inert and explosive fills (e.g., BLU-126), in other cases, multiple explosive fills, with the desired outcome being that detonation location or sequence moderates the output. A number of schemes have proposed multiple moderation devices (e.g., adaptable miniature initiation system technology ("AMIST")). As shown here, the moderation devices are interconnected, and yield is varied by means of selecting the location and sequence of moderation events. Finally, the Air Force Research Lab ("AFRL") explored the use of a spiral cutter charge (a spiraled linear shaped charge jet ("SLSCJ")).

Turning now to FIGS. 23 to 26, illustrated are views of embodiments of portions of a warhead of a weapon constructed according to the principles of the present invention. Beginning with FIG. 23, the weapon includes a mandrel 2310 employable to form and manipulate a SLSCJ 2320. The mandrel 2310 is desirable for the purpose of controlling the spiral configuration of the SLSCJ 2320 and can be integral as a mold to form a warhead liner (see below).

Figure 24:
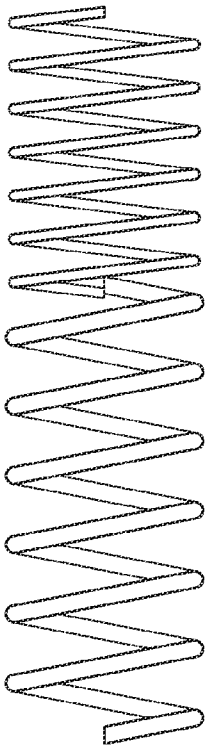
Figure 23:
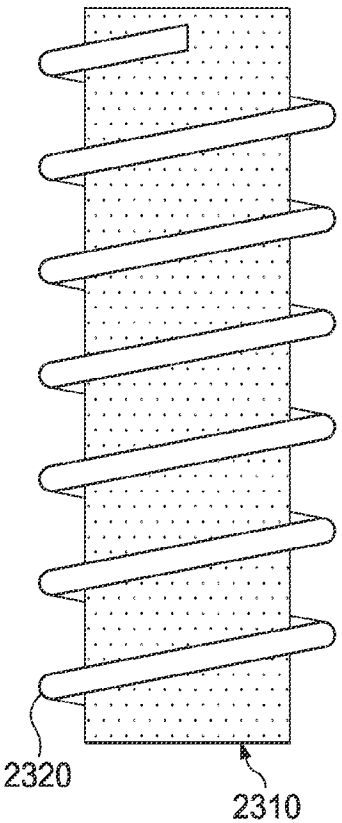

Regarding FIG. 24, illustrated is a SLSCJ with a variable wrap, which is desirable for the purpose of controlling a cutter transfer timing of the warhead. The linear progress of the cutter function, along the length of the warhead, is slower in the area of tighter wrap, providing for more precise control in this region. This can be achieved either by variable wrap along a single warhead, as shown here, or by using tighter wraps on devices that require more precise control, and looser wraps on those where precise control is unnecessary. The looser wrap provides a faster warhead function, and provides a lower cost SLSCJ, because it uses less cutter material.

It should be understood that a very fast linear burn rate of the SLSCJ can be difficult to precisely control in some circumstances. One means of achieving better control, and for some warhead shapes, better controlling hazardous fragmentation (e.g., case fragment size), is to use the variable wrap. Again, the variability may be employed across the length of the warhead, as shown in this figure, or may vary with shape for non-cylindrical warheads. In a related embodiment, different size cutter charges may be employed to accommodate variable warhead case thickness, or fill diameter. When multiple cutter sizes are used, the linear burn rate of the cutter can be affected by cutter size, and variable wrap rate is a means to compensate for these changes.

Figure 25:
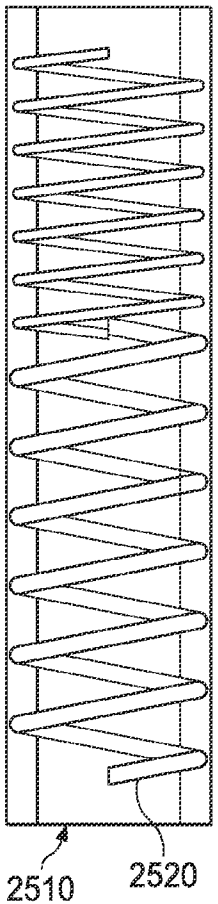

Turning now to FIG. 25, illustrated is an integrated liner 2510 that eases assembly and controls a configuration of an SLSCJ 2520. The illustrated embodiment provides a means to deliver the SLSCJ 2520 to a conventional warhead load assembly and pack ("LAP") facility without requiring SLSCJ tooling or other capital equipment and a low cost assembly with shaped charge jet ("SCJ") standoff control. A control of shaped charge jet standoff is an important factor in system operation because the location of the explosion from the shaped charge allows the shaped charge to be properly focused to allow good quality energy transfer to the recipient material. The liner 2510 provides a practical means to manage the standoff. Thus, the liner 2510 ensures that the configuration of the SLSCJ 2520 is properly maintained and properly positioned with respect to the warhead case. From a manufacturing perspective, this present design allows for the cutter assembly to be manufactured separately from the load assembly and pack.

Figure 26:
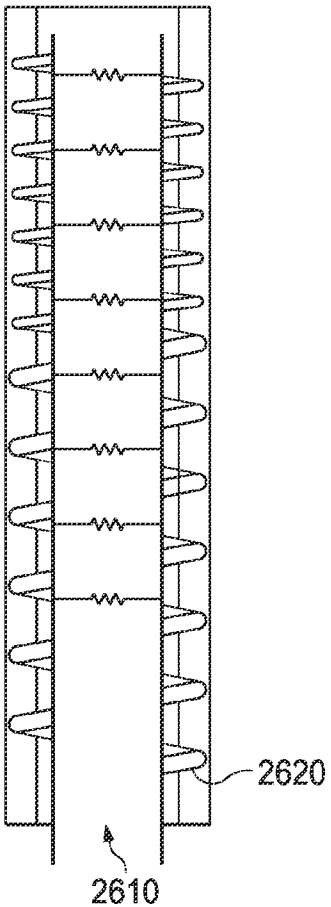
FIGS. 23 to 26 illustrate views of embodiments of portions of a warhead of a weapon constructed according to the principles of the present invention.

Although the integrated assembly is called a liner or case liner, it is not limited to a conventional liner, conformal to the inner diameter of a warhead case. Other exemplary embodiments include instances wherein the integrated assembly could be installed outside the warhead case, or as a sub-diameter assembly coaxial to the warhead case, or in other configurations. It should be clear to those skilled in the art that the mandrel is one desirable means to form the integrated assembly though not absolutely necessary to achieve the desired effects As illustrated in FIG. 26, an integrated resistor ladder 2610 allows control electronics to monitor the progress of the cutter. The resistor ladder 2610 also provides a mechanism to control the timing of detonation of a main charge as the control circuit measures a decrease in resistance during the cutter burn. Other similar circuits should be clear to those skilled in the art, such as a capacitance ladder, or a simple series of connectors, which are interrupted by being cut, and directly form a type of digital logic indicating the position of the cutter burn. It should be clear to those skilled in the art that incorporating the resistance ladder 2610 is useful, and that integrating the ladder 2610 into a liner 2620 provides a means of simple warhead assembly, along with other benefits. It should be clear to those skilled in the art that the mandrel is one desirable means to form the integrated assembly though not absolutely necessary to achieve the novel advantages of this invention.

Additionally, exemplary embodiments of the present invention have been illustrated with reference to specific components. Those skilled in the art are aware, however, that components may be substituted (not necessarily with components of the same type) to create desired conditions or accomplish desired results. For instance, multiple components may be substituted for a single component and vice-versa. The principles of the present invention may be applied to a wide variety of weapon systems. Those skilled in the art will recognize that other embodiments of the invention can be incorporated into a weapon that operates on the principle of lateral ejection of a warhead or portions thereof. Absence of a discussion of specific applications employing principles of lateral ejection of the warhead does not preclude that application from failing within the broad scope of the present invention.

Although the present invention has been described in detail, those skilled in the art should understand that they can make various changes, substitutions and alterations herein without departing from the spirit and scope of the invention in its broadest form. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A seeker, comprising:

a detector configured to receive a distorted signal impinging on an objective lens from a target, said objective lens comprising a front surface with a central region being a non-planar cone and outer regions being sharper cones, memory configured to store target criteria and a correction map, and a processor configured to provide a correction signal based on said distorted signal, said target criteria and said correction map to guide a weapon to said target.

2. The seeker as recited in claim 1 wherein said objective lens is integrated with a hemi-dome of said seeker.

3. The seeker as recited in claim 1 wherein said objective lens includes a fast fresnel lens.

4. The seeker as recited in claim 1 wherein said objective lens comprises a back surface configured to provide a complementary corrective curvature to said front surface of said objective lens.

5. The seeker as recited in claim 1 wherein said objective lens comprises a back surface with at least a portion formed by a conic surface.

6. The seeker as recited in claim 1 further comprising a dome configured to provide environmental protection for said objective lens.

7. The seeker as recited in claim 1 further comprising a standoff between said objective lens and said detector.

8. The seeker as recited in claim 1 wherein said correction map is derivable in accordance with a response map from a calibration array in comparison to known angles of illumination.

9. A weapon, comprising:

a warhead including destructive elements; and a guidance section with a seeker, including:

a detector configured to receive a distorted signal impinging on an objective lens from a target, said objective lens comprising a front surface with a central region being a non-planar cone and outer regions being sharper cones, memory configured to store target criteria and a correction map, and a processor configured to provide a correction signal based on said distorted signal, said target criteria and said correction map to guide said weapon to said target.

10. The weapon as recited in claim 9 wherein said objective lens is integrated with a hemi-dome of said seeker.

11. The weapon as recited in claim 9 wherein said objective lens includes a fast fresnel lens.

12. The weapon as recited in claim 9 wherein said objective lens comprises a back surface configured to provide a complementary corrective curvature to said front surface of said objective lens.

13. The weapon as recited in claim 9 wherein said objective lens comprises a back surface with at least a portion formed by a conic surface.

14. The weapon as recited in claim 9 wherein said seeker includes a dome configured to provide environmental protection for said objective lens.

15. The weapon as recited in claim 9 wherein said seeker includes a standoff between said objective lens and said detector.

16. The weapon as recited in claim 9 wherein said correction map is derivable in accordance with a response map from a calibration array in comparison to known angles of illumination.

* * * * *